US008690830B2

(12) United States Patent
Carlson et al.

(10) Patent No.: US 8,690,830 B2
(45) Date of Patent: Apr. 8, 2014

(54) IN-PLANE ELECTROMAGNETIC MEMS PUMP

(75) Inventors: Gregory A. Carlson, Santa Barbara, CA (US); John S. Foster, Santa Barbara, CA (US); Christopher S. Gudeman, Lompoc, CA (US); Steven S. Hovey, Goleta, CA (US); Paul J. Rubel, Santa Barbara, CA (US)

(73) Assignee: Innovative Micro Technology, Goleta, CA (US)

( * ) Notice: Subject to any disclaimer, the term of this patent is extended or adjusted under 35 U.S.C. 154(b) by 299 days.

(21) Appl. No.: 12/801,162

(22) Filed: May 26, 2010

(65) Prior Publication Data

US 2011/0295229 A1 Dec. 1, 2011

(51) Int. Cl.
*A61M 1/00* (2006.01)
*A61K 9/22* (2006.01)

(52) U.S. Cl.
USPC ..... 604/151; 604/891.1

(58) Field of Classification Search
USPC ..... 604/891.1
See application file for complete search history.

(56) References Cited

U.S. PATENT DOCUMENTS

| | | | | |
|---|---|---|---|---|
| 4,519,792 | A * | 5/1985 | Dawe | 604/152 |
| 6,116,863 | A * | 9/2000 | Ahn et al. | 417/322 |
| 7,220,594 | B2 | 5/2007 | Foster et al. | |
| 2006/0178709 | A1 | 8/2006 | Foster et al. | |
| 2007/0048154 | A1 * | 3/2007 | Sapir | 417/413.2 |

OTHER PUBLICATIONS

U.S. Appl. No. 12/662,237, filed Jul. 4, 2010, John. S. Foster, et al.
"Simulation of MEMS Piezoelectric Micropump for Biomedical Applications," U. Gonzalez, et al., http://www.algor.com/news_pub/tech_white_papers/MEMS_picropump/default.asp, Jun. 10, 2008.

* cited by examiner

*Primary Examiner* — Jason Flick
(74) *Attorney, Agent, or Firm* — Jaquelin K. Spong

(57) ABSTRACT

A micromechanical pumping system is formed on a substrate surface. The pumping system uses a pumping element which pumps a fluid through valves which move in a plane substantially parallel to the substrate surface. An electromagnetic actuating mechanism may also be fabricated on the surface of the substrate. Magnetic flux produced by a coil around a permeable core may be coupled to a permeable member affixed to a pumping element. The permeable member and pumping element may be configured to move in a plane parallel to the substrate. The electromagnetic actuating mechanism gives the pumping system a large throw and substantial force, such that the fluid pumped by the pumping system may be pumped through a transdermal cannula to deliver a therapeutic substance to the tissue underlying the skin of a patient.

27 Claims, 19 Drawing Sheets

IN-PLANE ELECTROMAGNETIC MEMS PUMP

CROSS REFERENCE TO RELATED APPLICATIONS

Not applicable.

STATEMENT REGARDING FEDERALLY SPONSORED RESEARCH

Not applicable.

STATEMENT REGARDING MICROFICHE APPENDIX

Not applicable.

FIELD OF THE INVENTION

This invention relates to the pumping of small volumes of fluids. More particularly, this invention relates to a microelectromechanical systems (MEMS) in-plane electromagnetic pump for pumping small volumes of fluids.

BACKGROUND

Microelectromechanical systems (MEMS) are small, generally movable devices which are made using semiconductor integrated circuit fabrication techniques. Because of these batch processing techniques, large numbers of small MEMS devices can be made on a single wafer substrate at low cost with high precision. MEMS devices typically have dimensions on the order of microns, and can thus be used to make very small actuators which are capable of very small and precise movements. Such actuators can make use of any of a number of phenomena to produce motion in the movable member. MEMS actuators are known which use electrostatic, thermal, magnetostatic and piezo electric effects, for example, to produce motion in the movable actuator member.

Microelectromechanical systems (MEMS) techniques may also be used to produce fluid pumps with small pump displacements, and therefore very precise fluid pumping rates. For example, microfabricated piezoelectric actuators may be used in such pumps, which make use of piezoelectric materials. Piezoelectric materials are those which undergo a strain when a voltage is applied, or generate a voltage when a stress is applied. An exemplary prior art pump using the piezoelectric materials is shown in FIG. 1. The micropump can be made by depositing a stack of piezoelectric layers 10 on a thin diaphragm 20 which defines the pumping chamber 30. Application of a voltage to the piezoelectric stack 10 results in a deformation of the diaphragm 20, which draws the fluid into the chamber 30 through an inlet valve 40. When the voltage is discontinued, the diaphragm 20 returns to its original shape, forcing fluid out of the chamber 30 through an outlet valve 50. Piezoelectric micropumps generally produce a force perpendicular to the plane of the substrate on which they are deposited as shown in FIG. 1, and thus move fluid primarily in this direction. A thorough analysis of the attributes of such a pump is set forth in "Simulation of MEMS Piezoelectric Micropump for Biomedical Applications", which discusses the speed and displacement of such a pump, and can be accessed at http://www.algor.com/news_pub/tech_white_papers/MEMS_micropump/default.asp.

Lead zirconate titanate, $Pb(Zr,Ti)O_3$ (PZT), is a common piezoelectric material that can be deposited on silicon wafers by RF sputtering, for example. However, care must be taken to relieve the stresses in the deposited material in order to avoid static deformation, or warpage, of the pumping diaphragm. Alternatively, high performance PZT wafers are also under development; however they are not yet available in sufficiently large (150 mm round) format to facilitate wafer-to-wafer bonding, an essential process for low cost manufacturing. Accordingly, the exemplary piezoelectric micropump shown in FIG. 1 is an idealized case, with zero residual stress, and such pumps tend to be expensive and difficult to fabricate.

This technology has several other drawbacks, the most significant of which are that the piezoelectric pump has limited throw and requires large actuation voltages. If non-resonant excitation of the above structure is used to actuate the diaphragm, the displacement of the design shown in FIG. 1 is less than 10 μm for a 200V input. If resonant excitation is used; i.e. a modulated voltage waveform is applied to the device to amplify the displacement, a ten fold increase in the displacement can be achieved; however, it takes about 100 msec to achieve this displacement. The low resonant frequency is a result of the weight of the piezoelectric material and the size of the pumping diaphragm needed to achieve the necessary pumping volume. The mass of the volume of fluid may also contribute to the low resonant frequency. If the pump is operated above this resonant frequency, the displacement is greatly diminished to only about 3 μm at 500 Hz for 200V input.

Another drawback of the device shown in FIG. 1 is that the chambers and layout of the fluidic channels do not allow the passage of relatively large particles. For example, particles in excess of about 10 μm will not pass readily through this fluid path, because of the severe turns and small apertures in the path. Vertical pumps such as that shown in FIG. 1 may also be relatively expensive and difficult to fabricate, because the valves are necessarily formed vertically below the diaphragm using other layers.

Accordingly, a need exists for a micropump capable of delivering small volumes of fluids as well as particulate matter suspended in the fluid stream, and which is inexpensive and easy to fabricate.

SUMMARY

Disclosed herein is a MEMS electromagnetic pump which is capable of pumping slurries of particulate matter suspended in a fluid stream. The MEMS electromagnetic pump is disposed in a plane parallel to a surface of the substrate, and pumps the fluid in this plane. For at least this reason, relatively complex structures may be used for the input and output valves for this structure, as well as for the pumping element. Thus, the MEMS electromagnetic pump is relatively inexpensive and easy to fabricate, using MEMS surface micromachining techniques. Furthermore, the in-plane electromagnetic MEMS pump uses electromagnetic actuation, which is capable of generating at least about 3 mN of pumping force and at least 0.5 nl pump displacement. This pumping force may be sufficient to force the fluid through a 200 μm aperture cannula. Because of its relatively large pumping force, the in-plane electromagnetic MEMS pump may be coupled with a cannula or hypodermic needle and drug reservoir, to deliver a drug subcutaneously from a drug reservoir to a patient in need of the drug.

The in-plane electromagnetic MEMS pump may be used to deliver at least 60 μL/min of a solution-based drug. However, since 15 μm or more diameter particles may pass easily through its channels, it may also be used to deliver particle-based drugs in slurries.

The in-plane electromagnetic MEMS pump may be fabricated by forming a magnetically permeable member affixed to a pumping element, which may be a movable membrane, piston or diaphragm. In one embodiment, the pumping element may be coupled to a shaft which is attached to the walls of a relieved area by one or more restoring springs. In another embodiment, the pumping element may be coupled to a flexible diaphragm or membrane that separates two fluidic chambers. In either case, the permeable member may interact with magnetic flux circulating in a magnetic circuit, wherein a gap is formed in the circuit to allow the movement of the pumping element. When the circuit is energized, magnetic flux circulating in the circuit jumps across the gap, interacting with the permeable member and drawing it further into the gap. This may draw the pumping element back, enlarging the pumping chamber and drawing fluid through an inlet valve into the pumping chamber. When the circuit is not energized, restoring forces may move the pumping element back to its original position, and thus the restoring springs may be configured to resist movement of the pumping element in at least one of a plane perpendicular to and a plane parallel to the surface of the substrate. This may reduce or increase the volume of the pumping chamber, thus forcing fluid through an inlet or outlet valve.

The inlet and outlet valves may be passive devices which move against a set of stops according to the pumping pressure applied by the in-plane electromagnetic MEMS pump. Alternatively, they may be active devices, opening and closing under the control of a microcomputer, and timed to allow the pumping of the fluid in the desired direction at the desired rate. As active devices, they may be actuated using an electromagnetic actuation mechanism, similar to that which drives the central piston or diaphragm. The permeable member and magnetic circuit may also have one of a number of designs, depending on the requirements of the application.

Thus, the microfabricated pump described herein may be formed on a substrate having a top surface, at least one fluid valve formed on the substrate which is configured to move in a plane substantially parallel to the top surface of the substrate, a pumping element configured to move a fluid through the at least one fluid valve in a plane substantially parallel to the top surface. The microfabricated pump may further include a flux-generating portion which generates magnetic flux which interacts with the pumping element, wherein the pumping element exerts a pumping force on a fluid to move it in a direction substantially parallel to the substrate surface.

The drug delivery system including the microfabricated pump may also include a reservoir containing a volume of the therapeutic substance, a cannula that delivers the therapeutic substance to a region beneath the outer skin of a patient, and the microfabricated fluid pump. The microfabricated fluid pump may be formed upon a surface of a fabrication substrate, wherein the longest characteristic dimension of the microfabricated fluid pump is less than about 1000 μm, and wherein the microfabricated fluid pump is configured to pump the therapeutic substance from the reservoir through the cannula to the patient. The term "characteristic dimension" as used herein, may denote the length of a line spanning the extremeties of the device, taken along a symmetry axis of the device.

Because the pump displacement is small, the microfabricated pump is capable of delivering dosages in very small, well controlled amounts. Because the power requirements are also small, battery operation with a button-type battery is foreseen. For these reasons, it is anticipated that this pump design may be appropriate for the delivery of small amounts of drugs such as insulin on a nearly continuous basis to a diabetic patient. The in-plane electromagnetic MEMS pump may be designed to fit within an adhesive patch worn against the skin of diabetic patients, such that the device is able to operate in a way that closely mimics the function of the human pancreas. However, potential applications are not limited to diabetes treatments. It may also be used to deliver any of a wide range of medications, including chemotherapies, pain medication and other therapeutic compounds that are best administered in small, controlled dosages. For example, the in-plane electromagnetic MEMS pump may be used for the delivery of nitroglycerin (for chest pain), scopolamine (for motion sickness), nicotine (for smoking cessation), clonidine (for high blood pressure), and fentanyl (for pain relief), as well as hormones (for menopausal symptoms) and many other drugs/applications.

These and other features and advantages are described in, or are apparent from, the following detailed description.

BRIEF DESCRIPTION OF THE DRAWINGS

The present invention will be understood more fully from the following detailed description, and from the accompanying drawings, which however, should not be taken to limit the invention to the specific embodiments shown but are for explanation and understanding only. In the figures, like numbers may refer to the same, or analogous features in the various views.

DETAILED DESCRIPTION

The systems and methods set forth herein are describe a microfabricated fluid pump in which the fluid is pumped substantially in the plane of the device. The term "substantially parallel" or "substantially in the plane" should be understood to mean that the movement is intended by design to be in this plane, although because of manufacturing tolerances, gravitational forces and other minor variations, the movement may not be exactly in this plane. The actuation mechanism may be electromagnetic, wherein magnetic flux generated by a flux-generating mechanism which interacts with a magnetically permeable member. This interaction may retract a pumping element such as a piston or diaphragm. Upon cessation of the current in the coil, restoring springs return the pumping element to its original position. The movement of this pumping element changes the volumes of a pumping chamber, thus moving fluid through the pumping chamber. By combining the pumping element with a set of active or passive valves, a microfabricated pump may be realized. Finally, a method for manufacturing the microfabricated pump is set forth.

Figures 2A, 2B:
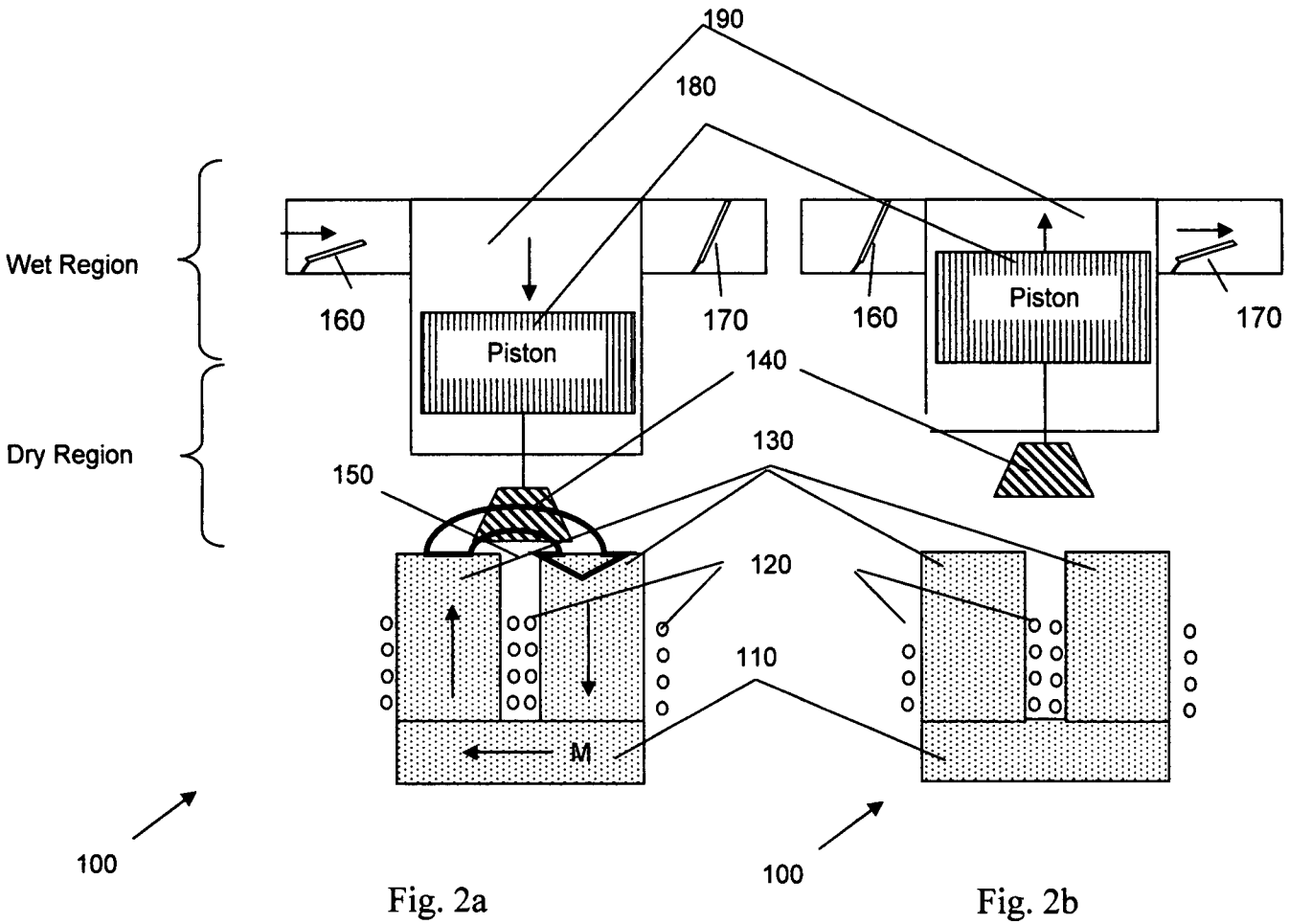
FIG. 2*a* is a simplified schematic view of the components of a first exemplary in-plane electromagnetic MEMS pump as it draws fluid into a pumping chamber.
FIG. 2*b* is a simplified view of the components of an exemplary in-plane electromagnetic MEMS pump as it pumps fluid out of the pumping chamber.

FIGS. 2*a* and 2*b* are simplified schematic diagrams of an exemplary in-plane electromagnetic MEMS actuator. The in-plane pump may include a force-generating mechanism which generates a force which moves the pumping element. The term "pumping element" as used herein may refer to any movable structure, whose movement forces movement of the fluid. The movement of the pumping element is caused by activation of the actuation means and force-generating device. The pumping element may be a piston or diaphragm affixed to an actuator, such that the force-generating mechanism causes the actual pumping movement. In the embodiment shown in FIGS. 2*a* and 2*b*, the force-generating mechanism is an electromagnetic motor, which generates magnetic flux as described further below. However, it should be understood that this embodiment is exemplary only, and that the force generating mechanism may use any number of actuation mechanisms, including electrostatic and piezoelectric, for example. As used herein, the terms "force generating" and "flux generating" are used interchangeably, as the force generating apparatus generally produces electrical or magnetic flux that interacts with the pumping element to produce movement in the pumping element.

The flux-generating mechanism may include two permeable cores 130 abutted with a permeable backstop 110. A number of conductive wires 120 may be wound or disposed around the two permeable cores 130. When the windings are energized, magnetic flux is generated and amplified within the permeable material cores 130 and backstop. With the windings appropriately configured, a magnetic circuit maybe formed, with flux circulating between one of the cores 130, across the permeable backstop 110, to the other permeable core 130, and across the narrow gap 150 between the permeable cores 130 as shown in FIG. 2*a*. As used herein, the term "narrow gap" should be understood to mean a distance which is smaller than the lateral extent of the magnetic cores 130 or permeable member 140.

When the flux crosses the narrow gap 150, it may interact with a movable, magnetically permeable member 140 which is coupled to a pumping element 180 by a shaft. Also coupled to the shaft, but not shown in FIG. 2*a* or 2*b*, may be one or more restoring springs, which tend to return the pumping element to its original position. The pumping element 180 may be a piston as shown in FIGS. 2*a* and 2*b*, or some other element whose movement alters the volume of the pumping chamber. 190. When the coils 120 are energized, the interaction of the flux with the permeable member 140 tends to draw the member into the gap, as is well known from magnetostatics. This withdraws the piston pumping element 180, enlarging the volume of the pumping chamber 190, and drawing fluid into the chamber 190 as shown in FIG. 2*a*.

When the current in the coils 120 ceases, the restoring springs (not shown in FIG. 2*a* or 2*b*) return the piston pumping element 180 to its original position. Thus, the restoring springs may be configured to resist movement of these elements in at least one of a plane perpendicular to and a plane parallel to the surface of the substrate. This movement reduces the volume of the pumping chamber, forcing fluid out as shown in FIG. 2*b*.

A valving mechanism may be provided for the in-plane electromagnetic pump, so that the fluid is drawn through an input valve 160 upon expansion of the pumping chamber 190, and forced out of an output valve 170 upon reduction of the pumping chamber. These valves 160 and 170 may be active, actuated mechanisms, or they may be passive mechanisms which move in response to the changing pressure within the pumping chamber. The valves 160 and 170 may be configured to move substantially in a plane parallel to the surface of the substrate. Passive valves 160 and 170 are illustrated in FIGS. 2*a* and 2*b*. These passive valves may be plates fabricated with a flexible leaf spring or hinge 165 attaching them to the walls of the pumping chamber. By their geometry, the plates of the passive valves may be allowed to only move in one direction in response to fluid pressure, to the right in FIGS. 2*a* and 2*b*, because mechanical interference with a détente feature in the walls of the pumping chamber 190 may preclude their movement in the other direction. The leaf springs or hinges attaching the plates to the walls are sufficiently flexible to allow the valves to open and admit fluid in response to the pressure generated by the moving pumping element 180. The hinges allow movement of the valve in a plane substantially parallel to the top surface of the substrate.

Because the pumping chamber 190 allows the passage of fluid from the input valve 160 to the output valve 170, it is necessarily wet, that is, fluid fills these cavities. However, ideally the fluid is kept away from the actuation mechanism, which is the permeable member 140, shaft and restoring springs (not shown). Accordingly, the pumping element 180, pumping chamber 190, input valve 160 and output valve 170 constitute a wet region of the microfabricated pump, whereas the permeable member 140, coils 120 and permeable cores 130 constitute a dry region of the microfabricated pump, as shown in FIGS. 2*a* and 2*b*. The fluid may be kept out of the dry region and restricted to the wet region by coating the surfaces of the dry region with a hydrophobic material. Suitable hydrophobic materials may include fluorocarbon lubricants such as AM2001 or Z-dol, sold by Dupont Corp. (Wilmington, Del.) which may be applied by dipping or vapor-depositing this material on the appropriate surfaces. The resulting fluorocarbon film may be approximately 10 to 20 Angstroms thick, and with some bonding affinity for the wafer surfaces. The function of the fluorocarbon film is to reduce wetting of these wafer surfaces in the dry areas of the cavities. Alternatively, the wet region may be coated with a hydrophilic material, or both may be coated with an appropriate material to influence the presence or expulsion of fluid.

The tendency of the fluid to move from the wet region to the dry region may also be resisted by making the fluid channels connecting these regions very narrow. That is, the channel space between the sides of the pumping piston 180 and the walls of the pumping chamber 190 is very narrow, on the order of a micron, which resists the flow of fluid through this channel.

Figures 3A, 3B:
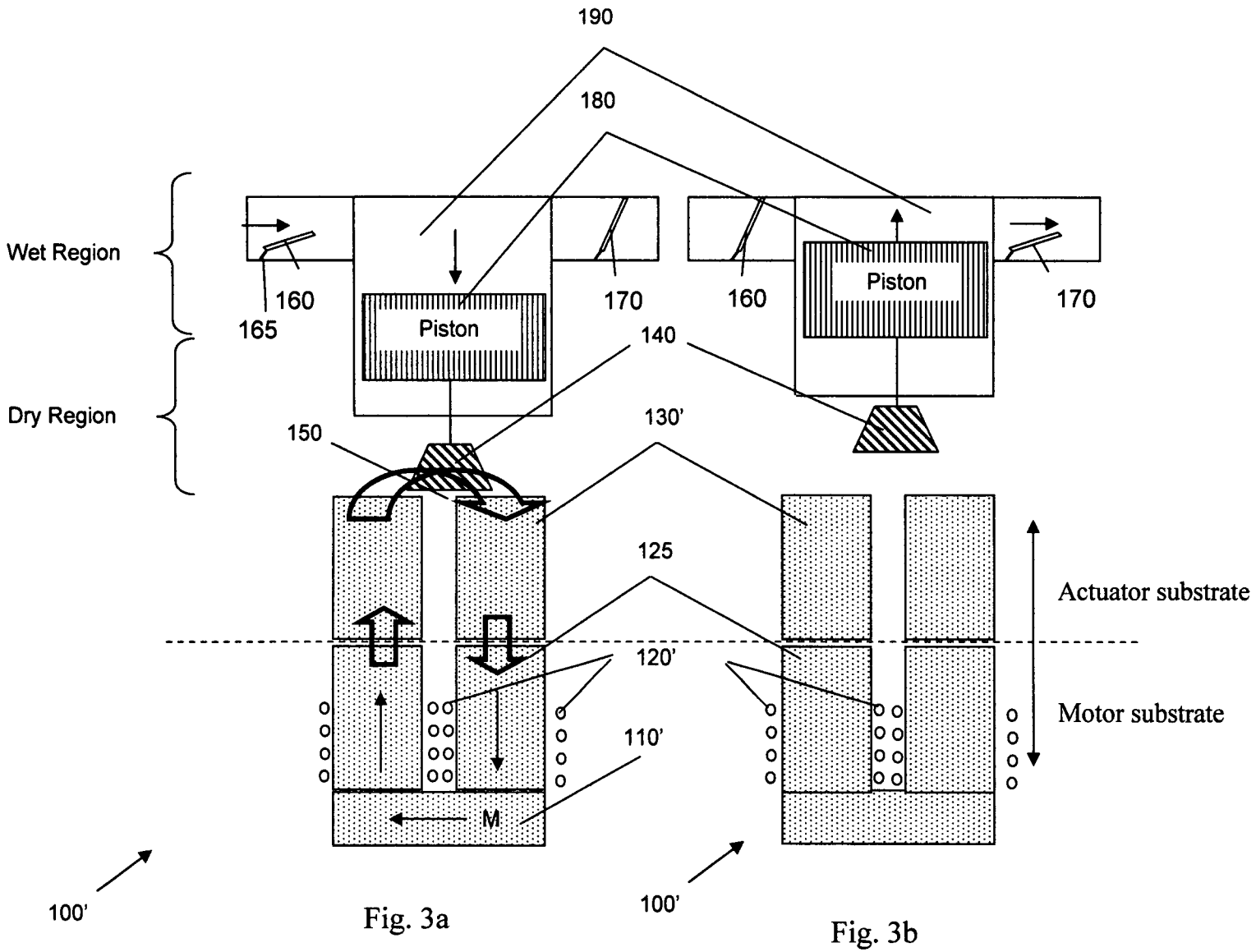
FIG. 3*a* is a simplified schematic view of a second exemplary in-plane electromagnetic MEMS pump, with the components of the electromagnetic driving mechanism formed on two substrates, as it draws fluid into a pumping chamber.
FIG. 3*b* is a simplified view of the second exemplary embodiment of the in-plane electromagnetic MEMS pump, with the components of the electromagnetic driving mechanism formed on two substrates, as it pumps fluid out of the pumping chamber.

FIGS. 3*a* and 3*b* show an alternative embodiment of the in-plane electromagnetic MEMS pump. In the embodiment illustrated in FIGS. 3*a* and 3*b*, the flux-generating mechanism is design to be in two pieces, on two different substrates. The first substrate, called the "motor substrate", includes the windings 120' around extended permeable cores 125, all of which are located on this motor substrate. The second substrate, called the "actuator substrate" supports the permeable cores 130' and member 140 which are located on this separate actuator substrate. The actuator substrate also supports the shaft, pumping element 180, pumping chamber 190, input and output valves 160 and 170. These items may be similar or identical to the corresponding features in FIGS. 2*a* and 2*b*. The motivation for dividing the flux-generating mechanism from the actuator mechanism is to reduce the cost and complexity of the microfabricated pump chip. By putting the windings on a separate substrate which is relatively cheap and easy to build, the actuator mechanism may remain relatively small, which may be an efficient use of wafer area.

To activate the actuator and therefore the microfabricated pump 100', the motor substrate is brought into proximity to the actuator substrate, such that flux generated in the extended cores 125 is coupled into the permeable cores 130' on the actuator substrate. When the coils 120' are energized, the permeable member 140 is pulled into the narrow gap 150 as shown in FIG. 3*a*, in a manner similar to microfabricated pump 100. Thus when the coils are energized, fluid is pulled through the inlet valve 160 as shown in FIG. 3*a*. When the current ceases in the windings 120', the restoring springs (not shown) return the member 140 to its original position, thus forcing fluid through the outlet valve 170.

Figures 4A, 4B:
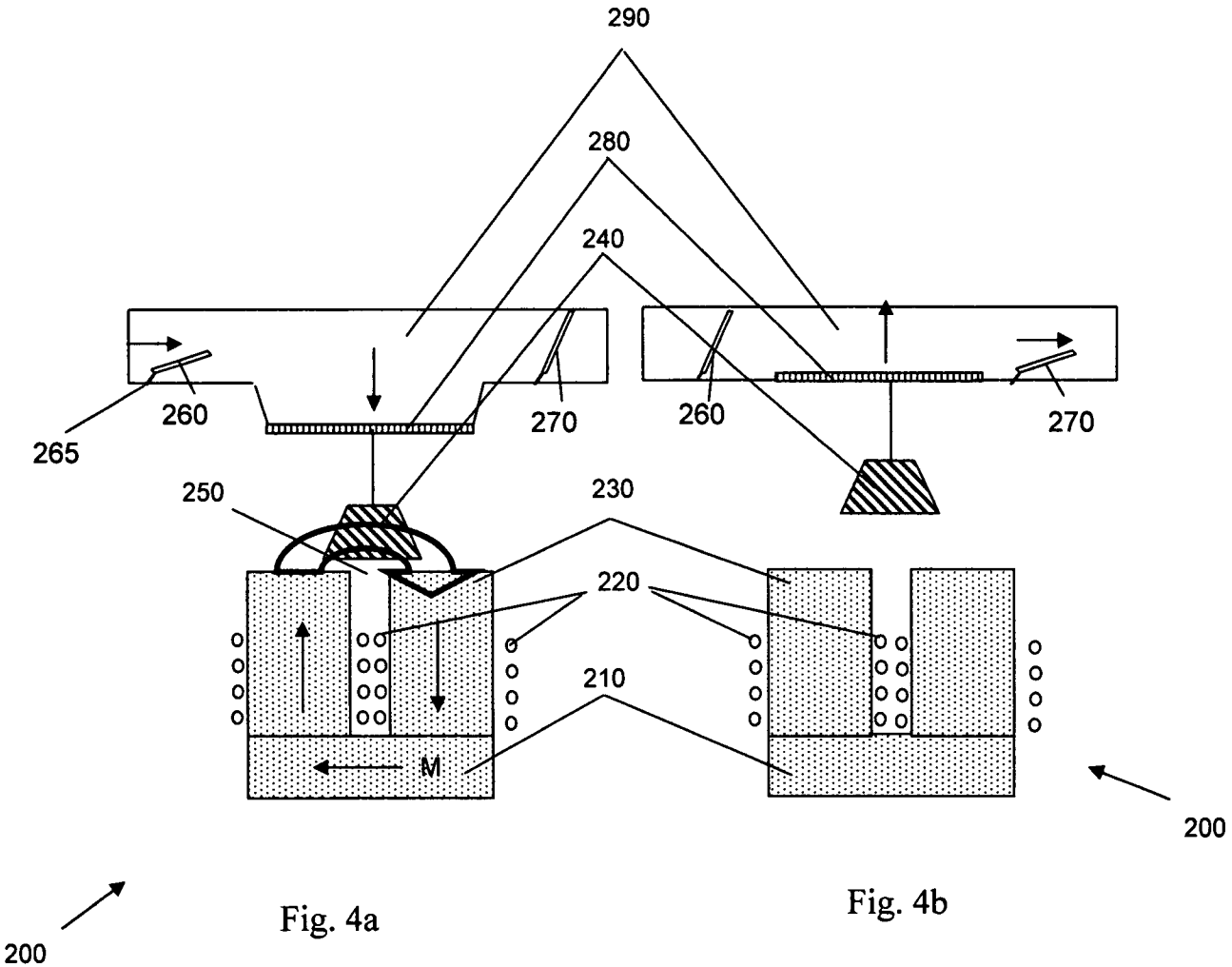
FIG. 4*a* is a simplified schematic view of a third embodiment of an in-plane electromagnetic MEMS pump, using a diaphragm rather than a piston, as it draws fluid into a pumping chamber.
FIG. 4*b* is a simplified view of the third exemplary embodiment of in-plane electromagnetic MEMS pump, using a diaphragm rather than a piston, as it pumps fluid out of the pumping chamber.

FIGS. 4*a* and 4*b* show a third exemplary embodiment of the in-plane electromagnetic MEMS pump. In a manner similar to in-plane electromagnetic MEMS pump 100, pump 200 includes current-carrying coils 220, backstop 210, permeable cores 230, and permeable member 240 separated from permeable cores 230 by a narrow gap 250. However, in pump 200, the pumping element is a diaphragm 280 rather than a piston 180. That is, at least one wall of the pumping chamber 290 is movable, and flexibly attached to other walls of the pumping chamber, while being rigidly attached to the shaft of the permeable member 240. In contrast, the piston pumping element 180 is not attached to the walls of the pumping chamber 190. By moving the shaft connected to the movable wall of the diaphragm pumping element 280, the volume of the pumping chamber 290 is changed. When the coils 220 are energized, the shaft is lowered by the interaction of permeable member 240 with the flux from the permeable cores 230. The movement of the diaphragm 280 increases the volume of the pumping chamber 290 thus drawing fluid through the input valve 260 which opens because of flexible hinge 265. When the current in the coils ceases, restoring springs (not shown) return the movable diaphragm to its original position, decreasing the volume of the pumping chamber 290 and forcing fluid through the outlet valve.

The third exemplary embodiment illustrated in FIGS. 4*a* and 4*b* uses the passive type of input valve 260 and output valve 270, as was described previously with respect to the second embodiment. However, it should be understood that this is exemplary only, and that the input and output valves may be either the active sort or the passive sort, or one may be of the active sort and the other the passive sort. It should also be understood that this embodiment may be fabricated on two separate substrates, as was illustrated in FIGS. 3*a* and 3*b*. In fact, it should be understood that the salient features of the different embodiments described herein may be mixed and matched in various ways, according to the requirements of the applications. The embodiments set forth herein are not intended to be an exhaustive set of the possible combinations, but rather illustrate exemplary ways in which these features may be combined.

Figures 5A, 5B:
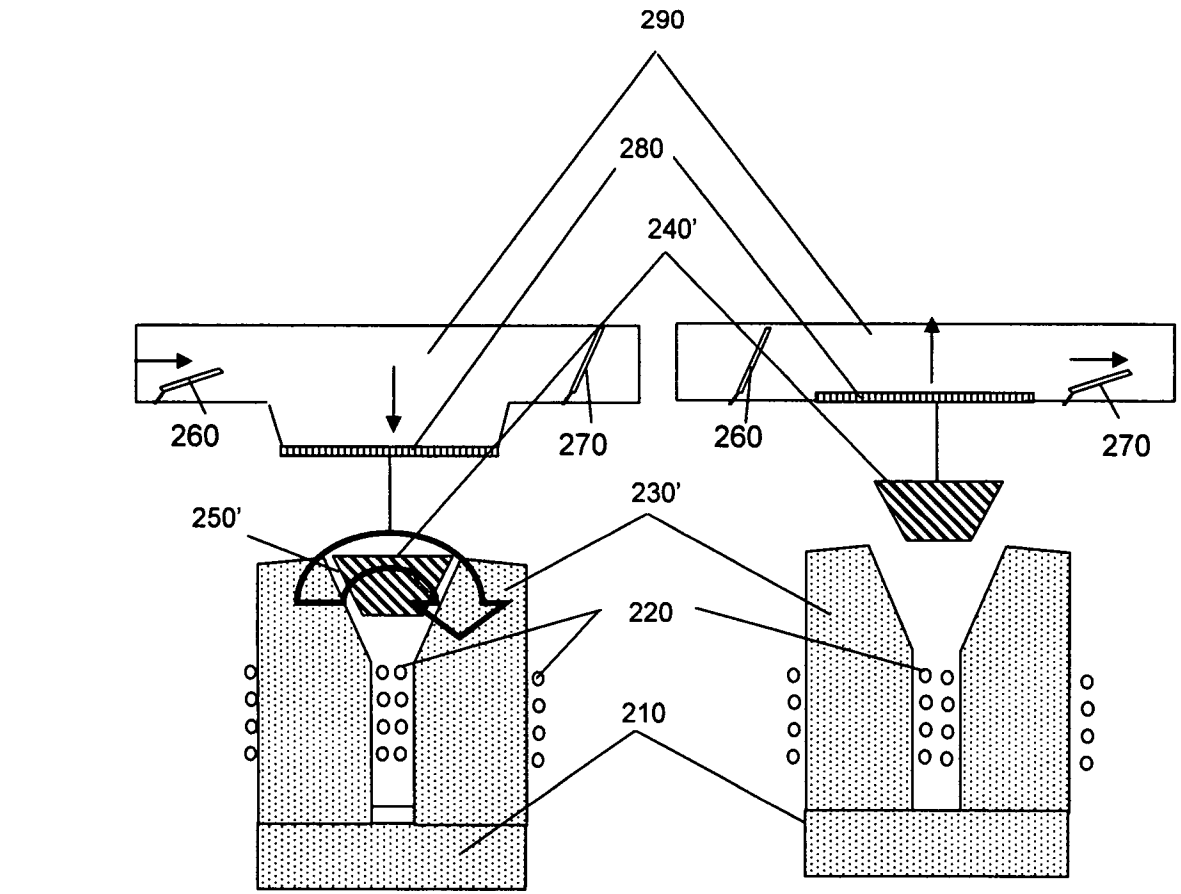
FIG. 5*a* is a simplified schematic view of a fourth exemplary embodiment of in-plane electromagnetic MEMS pump with an alternative design for the permeable member, as it draws fluid into a pumping chamber.
FIG. 5*b* is a simplified view of the fourth exemplary in-plane electromagnetic MEMS pump with an alternative design for the movable member, as it pumps fluid out of the pumping chamber.

A fourth exemplary embodiment 200' of the in-plane electromagnetic MEMS pump is illustrated in FIGS. 5*a* and 5*b*. In the fourth exemplary embodiment 200', the permeable member 240' and permeable cores 230' have a different shape compared to permeable member and cores 240 and 230 shown in FIGS. 4*a* and 4*b*. The other components, including the windings 220, backstop 210, diaphragm 280, pumping chamber 290, input valve 260 and output valve 270 are similar or identical in construction and function to those of third exemplary embodiment 200.

In FIG. 5*a*, the permeable member 240' has a shaped bottom whose contour matches the shape of the narrow gap 250', compared to the flat bottom of permeable member 240 of in-plane electromagnetic MEMS pump 200 shown in FIG. 4*a*. The flat-bottomed shape will henceforth be referred to as the "clapper" design, whereas the shaped-bottom design is the "keystone" design. Because of the matching of the contour of the keystone 240' with that of the gap 250', the flux coupling between movable member keystone design 240' and the permeable cores 230' may be more effective and provide more force to the MEMS pump 200', compared to the clapper design in in-plane electromagnetic MEMS pump 200. As a result, MEMS pump 200' may move more quickly than MEMS pump 200.

However, embodiment 200 with flat bottomed clapper member 240 may have other advantages relative to keystone embodiment 200'. For example, the clapper embodiment 200 may be less susceptible to lateral pull-in of the motor, in which if movable keystone member 240' is slightly offset from the midline between permeable cores 230, the force emanating from the closer core 230 is larger than the force emanating from the more-distant motor core. This unbalanced force causes the movable keystone member 240' to be pulled laterally, and as the movable keystone member 240' is pulled further to the side, the lateral force increases further. In contrast, embodiment 240 may be relatively insensitive to this effect. Movable clapper member 240 may also be less susceptible to stiction effects than movable keystone member 240'.

Figures 6A, 6B:
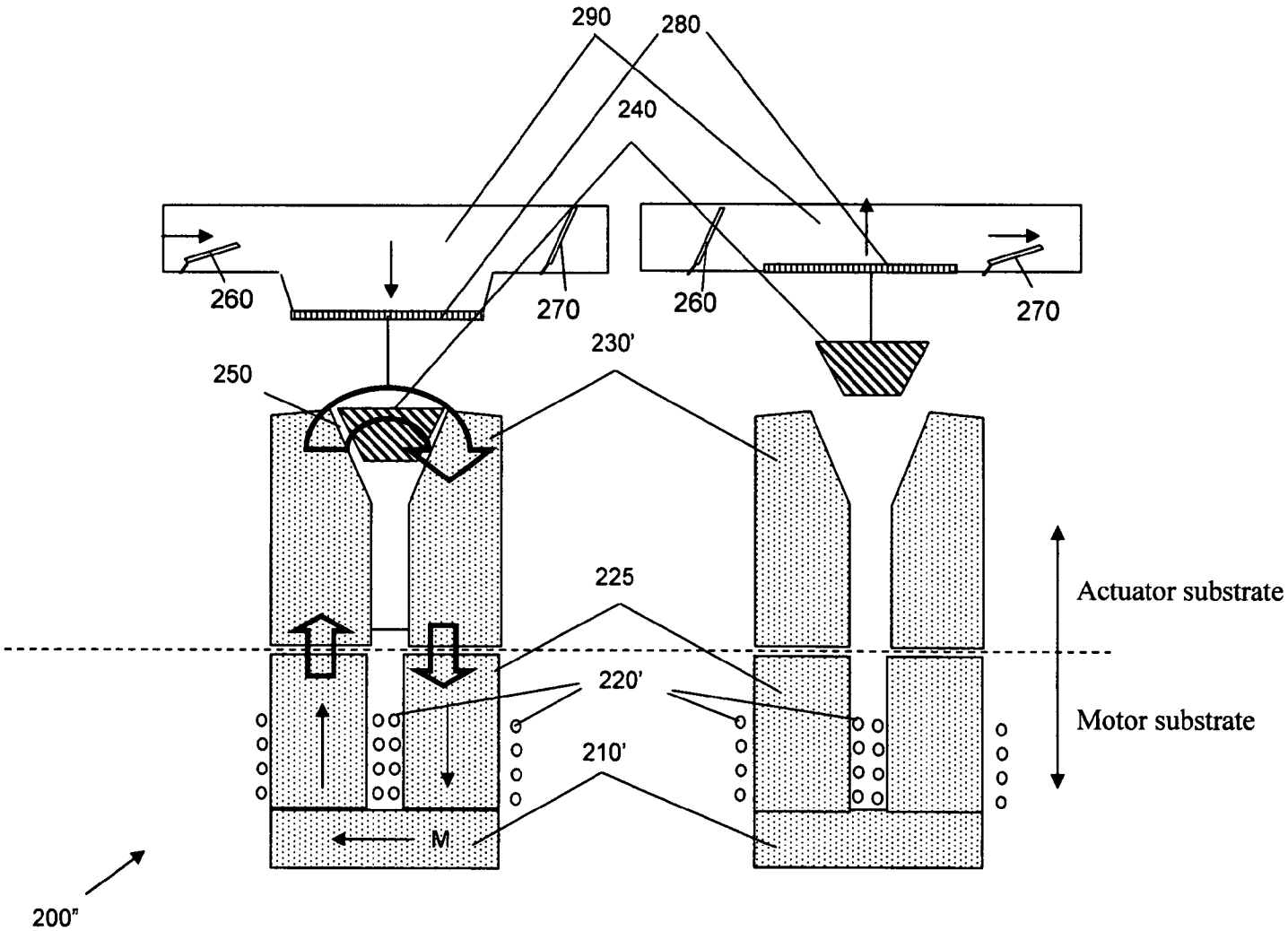
FIG. 6*a* is a simplified schematic view of the in-plane electromagnetic MEMS pump of FIG. 5*a*, with the components of the electromagnetic driving mechanism formed on two substrates, as it draws fluid into a pumping chamber.
FIG. 6*b* is a simplified view of the in-plane electromagnetic MEMS pump of FIG. 5*b*, with the components of the electromagnetic driving mechanism formed on two substrates, as it pumps fluid out of the pumping chamber.

FIGS. 6*a* and 6*b* illustrate a fifth exemplary embodiment, which is a keystone embodiment 200" with a separated motor substrate and actuator substrate. In a manner similar to that shown in FIGS. 3*a* and 3*b*, the flux generating mechanism is fabricated on a separate substrate, with coil windings 220' wrapped around permeable cores 225 on a separate substrate from permeable cores 230', shaft and pumping element 240. The operation of in-plane electromagnetic MEMS pump 200" is in other ways similar to that of in-plane electromagnetic MEMS pump 100'.

Figure 7:
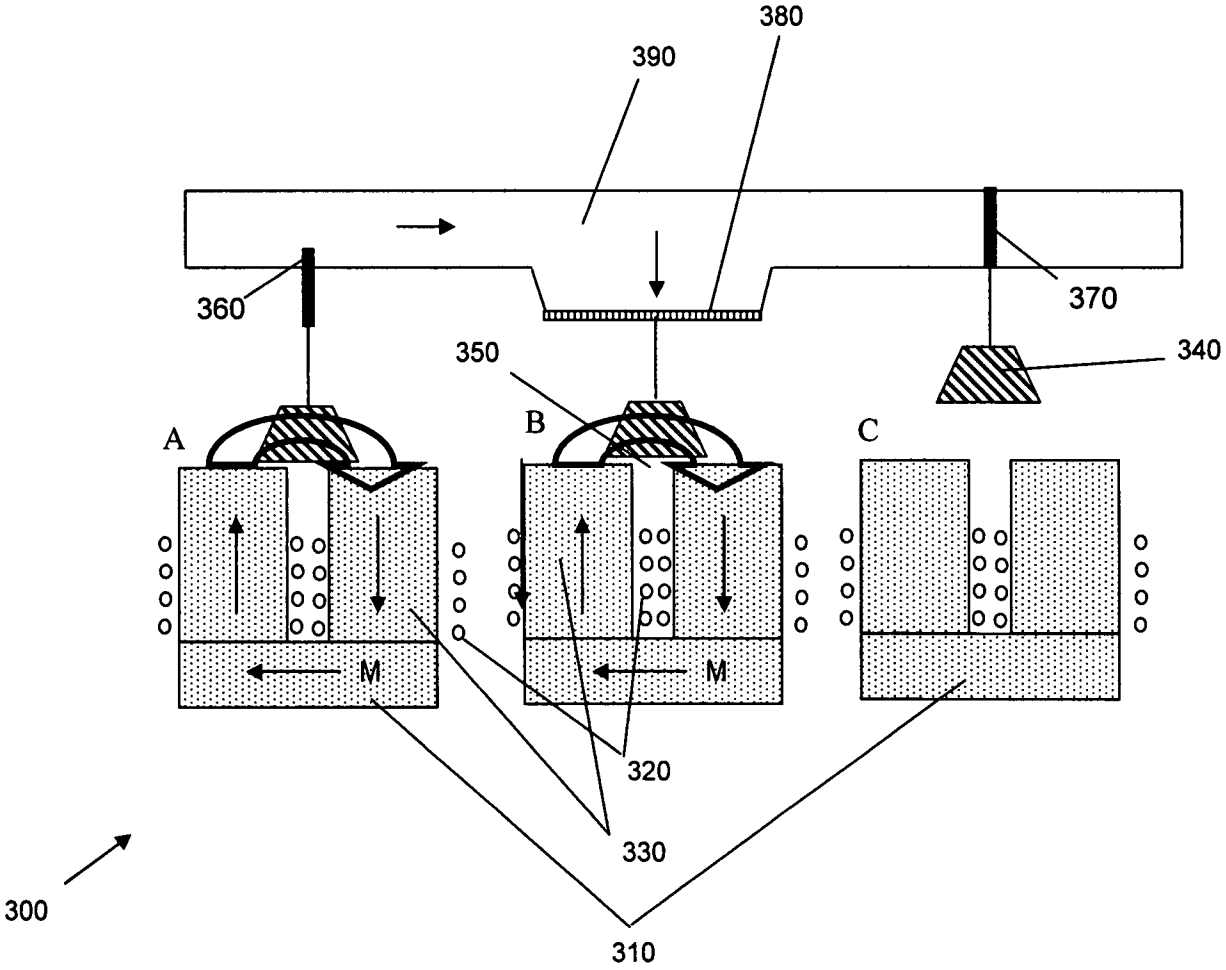
FIG. 7 is a simplified schematic view of an exemplary MEMS pumping system using the exemplary in-plane MEMS electromagnetic pump of FIGS. 4*a* and 4*b*, with active valving mechanisms drawing fluid into the pumping chamber.

A sixth exemplary embodiment is illustrated in FIG. 7. The sixth embodiment is similar to that illustrated in FIGS. 5*a* and 5*b*, except that this diaphragm-type in-plane electromagnetic MEMS pump uses the clapper design of permeable member 340 and active valving rather than passive valving. The active valves may be gate valves which are electromagnetically actuated, using a design similar to that of the diaphragm pumping element 380. In a manner analogous to the third exemplary embodiment, the sixth exemplary embodiment may also include the permeable cores 330, permeable backstop 310, coils 320, permeable member 340 and pumping chamber 390.

Figure 8:
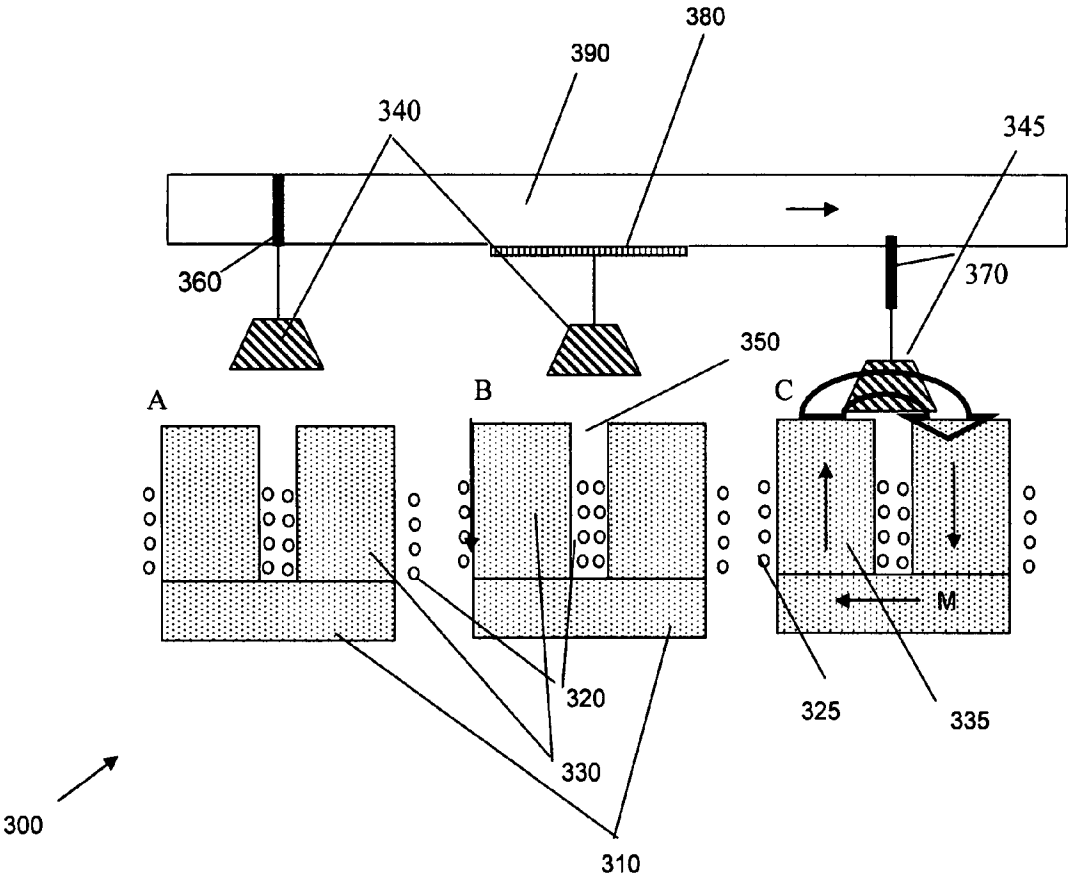
FIG. 8 is a simplified schematic view of an exemplary MEMS pumping system using the exemplary in-plane MEMS electromagnetic pump of FIGS. 4*a* and 4*b*, with active valving mechanisms, pumping fluid out of the pumping chamber.

FIG. 7 illustrates the intake portion of the pump stroke, whereas FIG. 8 illustrates the output portion. In FIG. 7, the coils 320 surrounding permeable cores 330 are energized either simultaneously or in rapid succession. The production of flux in the respective permeable cores draws the respective permeable members 340 toward the gap and closer to the permeable cores 330. This enlarges the pumping chamber 390, while opening the input valve 360. As a result, fluid is drawn into the pumping chamber through the input valve 360.

For the output portion of the pump stroke, coils 325 are energized whereas coils 320 are de-energized. Accordingly, permeable members 340 are returned to their original positions by restoring springs (not shown in FIG. 7 or 8). Simultaneously or in rapid succession, coil 325 is energized, which pulls output valve 370 into the open position. The return of pumping diaphragm 380 to its original position reduces the pumping volume of the chamber, thus forcing fluid through output valve 370. The output portion of the stroke is shown in FIG. 8.

Figure 9:
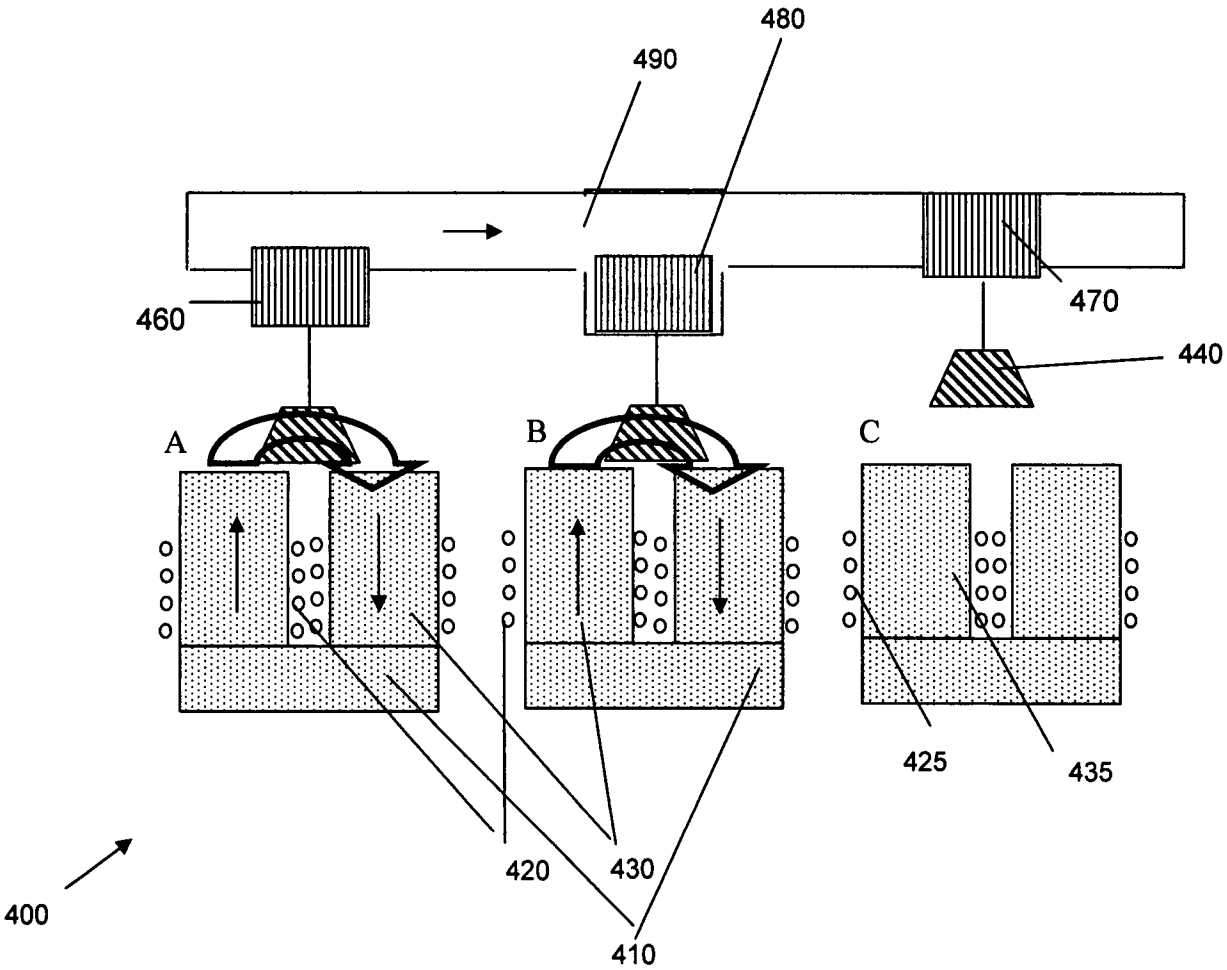
FIG. 9 is a simplified schematic view of an exemplary MEMS pumping system using the exemplary in-plane MEMS electromagnetic pump of FIGS. 2*a* and 2*b*, with active valving mechanisms, drawing fluid into of the pumping chamber.

FIG. 9 illustrates a seventh exemplary embodiment 400 of an in-plane electromagnetic MEMS pump, using a piston-style pumping element 480. The valving mechanism in this embodiment is active valving, wherein the opening of the input valve 460 and the output valve 470 is controlled by energizing the respective coils 420 and 425. The intake portion is accomplished by energizing coils 420 either simultaneously, or in rapid succession, which opens the input valve and draws the pumping piston element 480 down. The current to these coils then ceases, while coil 425 is energized. This allows the pumping piston element to return to its original position, forcing fluid out the now open output valve 470.

The choice between the diaphragm pumping element 380 and the piston pumping element 480 may depend on several considerations. For example, the piston pumping element 480 may be capable of a large pumping volume, because the piston is not itself attached to the walls of the pumping chamber. However, the piston pumping element 480 may have a higher leakage rate, because the fluid may migrate around the sides of the piston pumping element 480 in addition to the top and bottom. However, the diaphragm pumping element 380 may lend itself to a more compact design, because the diaphragm itself may provide the restoring force to return the pumping element to its original position. Such an embodiment will be discussed in greater detail with respect to FIG. 11, below.

The choice between active and passive valving may be made by weighing the need for pumping efficiency against simplicity of design. The passive valving mechanism, while simple to implement, may have poorer pumping efficiency, because some of the fluid pressure generated by the pumping element 180 must necessarily go to the opening of the valves rather than the movement of fluid through the valve. Thus, the passive valve approach may be expect to provide a less efficient, though perhaps a smaller, simpler pump that is easier to control.

Figure 10:
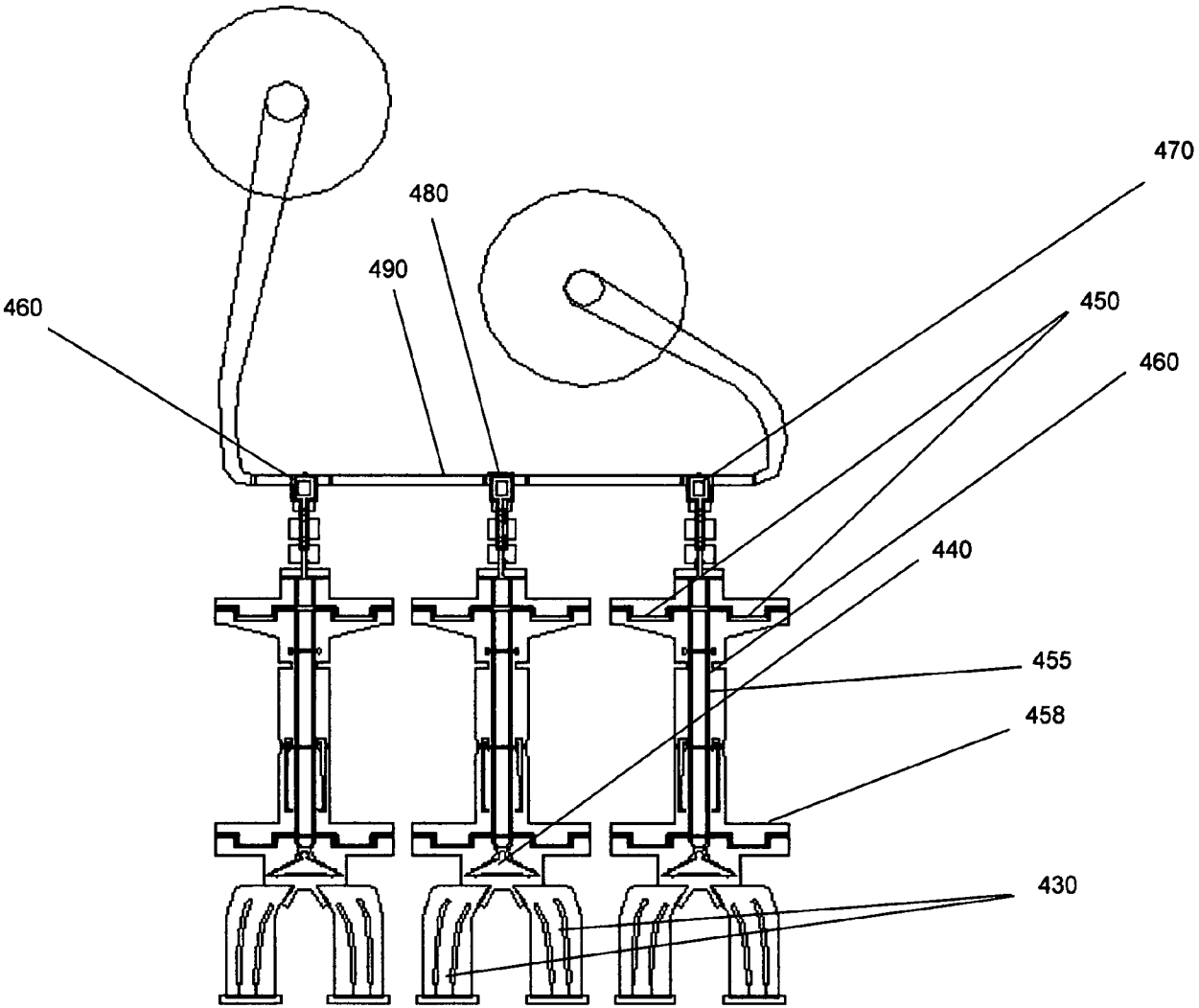
FIG. 10 is a design layout of an exemplary MEMS pumping system using the exemplary in-plane MEMS electromagnetic pump shown schematically in FIG. 9, with active valving mechanisms.

FIG. 10 shows a layout of in-plane electromagnetic MEMS pump 400, that is, the device shown in FIG. 10 may be an actual implementation of the device shown schematically in FIG. 9. In addition to the permeable cores 430, permeable member 440, pumping element 480, pumping chamber 490, and input and output valves, 460 and 470, a plurality of restoring springs 450 are shown in FIG. 10. The restoring springs 450 may be thin arms of silicon which attach the pumping shaft 455 to the sides of the cavity 458. The arms may be formed by removing all other portions of the silicon substrate to define the cavity, while leaving the thin arms 450. The arms are designed to be sufficiently thin and flexible to allow flexing in the direction parallel to the plane of the substrate. However, the restoring force of the silicon is strong enough to return the pumping element 480 to its original position upon cessation of the current. Thus, the restoring springs may be configured to resist movement of these elements in at least one of a plane perpendicular to and a plane parallel to the surface of the substrate, and the restoring force may be sufficient to return the elements to their original positions. The requirement for a certain pumping rate may determine the spring force required from the restoring springs, as the faster the pump is required to operate, the larger the spring force required on the restoring springs. This may, in turn, require a larger magnetostatic force to be delivered by the electromagnetic actuator, to overcome this restoring force.

In the embodiment shown in FIG. 10, the flux-generating cores and coils are located on the separate motor substrate in this embodiment, as was shown schematically in FIGS. 3*a*, 3*b*, 6*a* and 6*b* and thus do not appear in FIG. 10. Thus, the number of coils, and the flux generated thereby, may be optimized in the design of the motor substrate without impacting the size of the actuator substrate. As with preceding designs, the permeable cores 430 route the flux to the gap, in which the flux interacts with the permeable clapper member 440, drawing it closer to the permeable cores when the device is energized. Similar signals may be applied to open and close the valves 460 and 470, as described previously with respect to other active valve designs.

Figure 11:
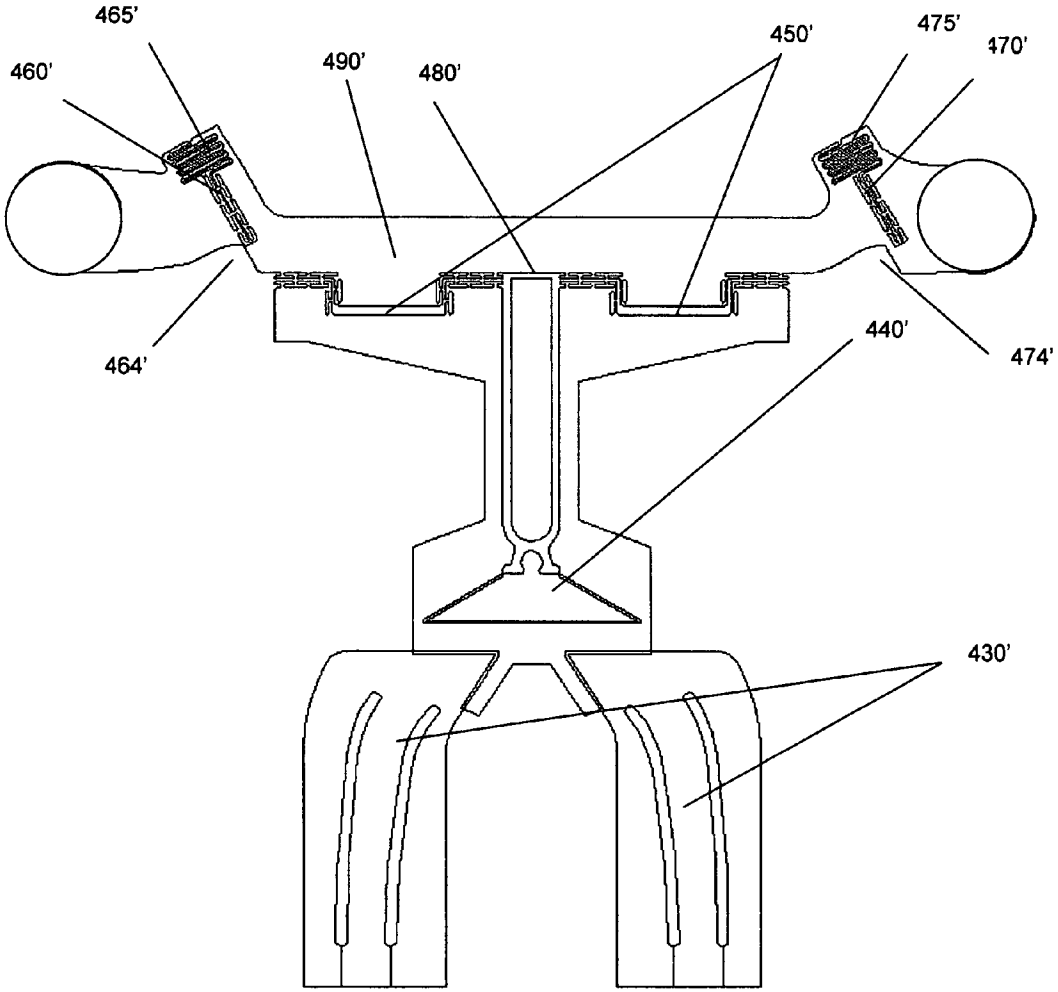
FIG. 11 is a design layout of a compact exemplary MEMS pumping system using the exemplary in-plane MEMS electromagnetic pump shown schematically in FIGS. 4*a* and 4*b*, with passive valving mechanisms.

FIG. 11 shows another embodiment of the in-plane electromagnetic MEMS pump, in which the design is made more compact by allowing the diaphragm pumping element 480' to also serve as the restoring spring. Although this design uses the clapper movable member 440' and passive valving 460' and 470', it should be understood that this basic approach may be combined with other alternatives, such as the keystone permeable member and active valving. It is estimated that this design may consume a wafer area of only about 0.5 mm by 0.7 mm, and requires only control of the diaphragm pumping element 480'. In this embodiment, the restoring springs 450' also constitute the pumping diaphragm, thus allowing the compact layout. The flexibility of the restoring spring/diaphragm is determined largely by its dimensions and shape. The four ninety-degree bends in the springs 450' allow it to flex in the direction parallel to the substrate surface rather easily. It is estimated that this spring/diaphragm design provides a restoring force of around 3 mN at maximum displacement. As with the design shown in FIG. 10, the flux-generating apparatus of the electromagnetic actuator may be fabricated on a separate motor substrate, and thus is not shown in FIG. 11.

The passive valve 460' and 470' may be of similar design to the restoring springs 450' and fabricated by removing all other portions of the silicon substrate within the cavity. The serpentine shape of the hinges 465' and 475', of valves 460' and 470', respectively, give the valves good flexibility in the direction parallel to the substrate surface, while maintaining their rigidity in the perpendicular direction. Mechanical interference between the valves 460' and 470' and détente features 464' and 474', respectively, prevent the valves from moving in the opposite directions. Thus, to the extent that there is no leakage through the valves, the input valve will only allow flow into the pumping chamber 490', and the output valve 470' will only allow flow out of the pumping chamber 490'.

Figure 1:
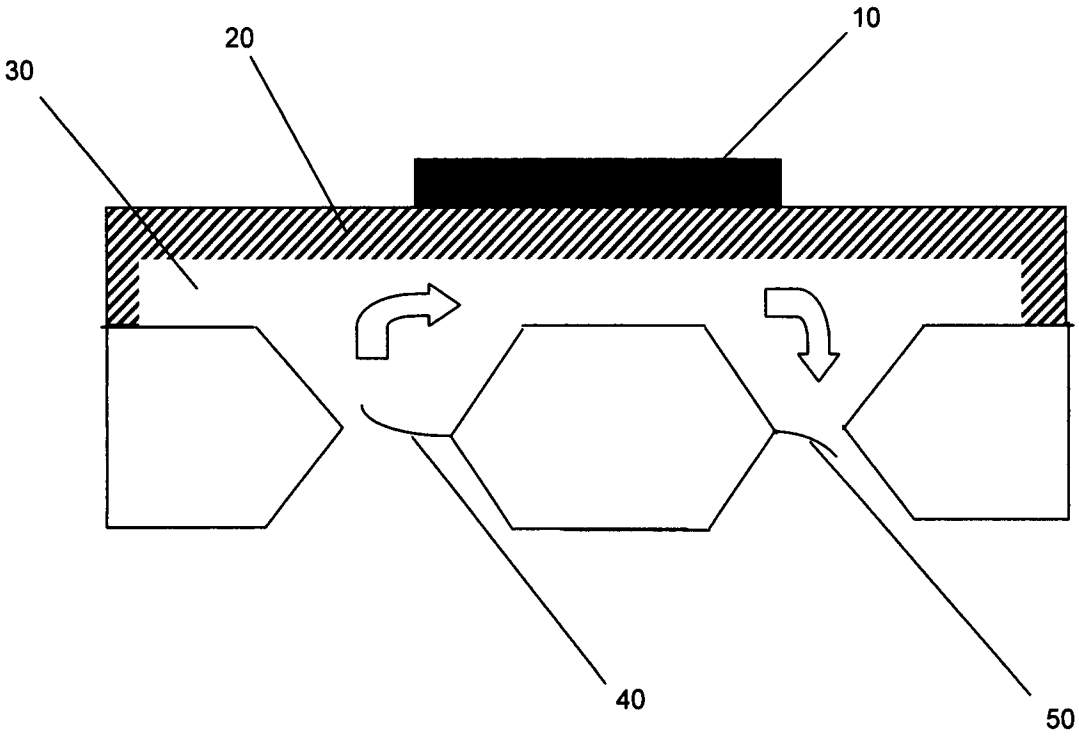
Fig. 1 (Prior Art)
FIG. 1 is a simplified schematic view of a prior art piezoelectric micropump.

A comparison of FIGS. 10 and 11 to FIG. 1 reveals an important distinction between in-plane MEMS pump depicted there and the prior art pump 1. In prior art pump 1, the valves are formed by different layers, and operate vertically in a stack. That is, the valves 60 and 70 are designed to move in a plane substantially orthogonal to the plane of the surface of the substrate which supports the valves 60 and 70. The valves 60 and 70 may be formed by first forming a channel in a substrate, covering the channel with another layer, and then forming the flexible valve members in the other layer.

In contrast, in FIGS. 10 and 11, the valve members are formed in a single layer and operate in the plane of that layer. The in-plane pump valve members move in a plane substantially parallel to the plane of the substrate, rather than perpendicularly to the substrate. This allows the process for making valves 460, 470, 460' and 470' to be much simpler than the process used to make valves 60 and 70. Valves 460' and 470' for example, may be made in a single photolithography step, by deep reactive ion etching the appropriate pattern through the device layer of an SOI substrate, and etching the underlying oxide to free the movable valve members. This is substantially simpler that the multiple fabrication steps required for valves 60 and 70 of prior art pump 1.

The subsequent figures illustrate alternative embodiments for the flux-generating apparatus of the in-plane electromagnetic MEMS pump, which may be formed on a separate substrate which generally supports the movable components of the MEMS pumps.

Figure 12:
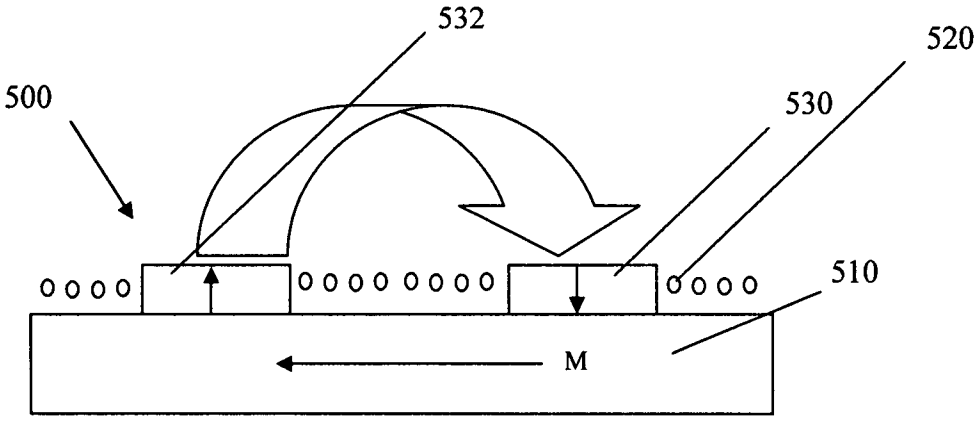
FIG. 12 is a simplified schematic cross-sectional view of an exemplary flux-generating mechanism for in-plane MEMS electromagnetic pump on a separate substrate.

FIG. 12 illustrates a first embodiment of a flux-generating apparatus for an in-plane electromagnetic MEMS pump. In this embodiment, a pair of coils 520 is disposed about axes which are perpendicular to the face of the substrate, in a pancake configuration. In some exemplary embodiments, the coils are fabricated in a single layer, and disposed around a set of permeable posts 530, 532. The coils 520 and permeable posts 530, 532 may be disposed over a permeable backstop 510, which serves to transmit the flux from one permeable post 530 to the other permeable post 532. In the absence of an adjacent actuator substrate, the flux is required to jump across the air gap between one permeable post 532 to the other permeable post 530, as illustrated in FIG. 12.

Figure 18:
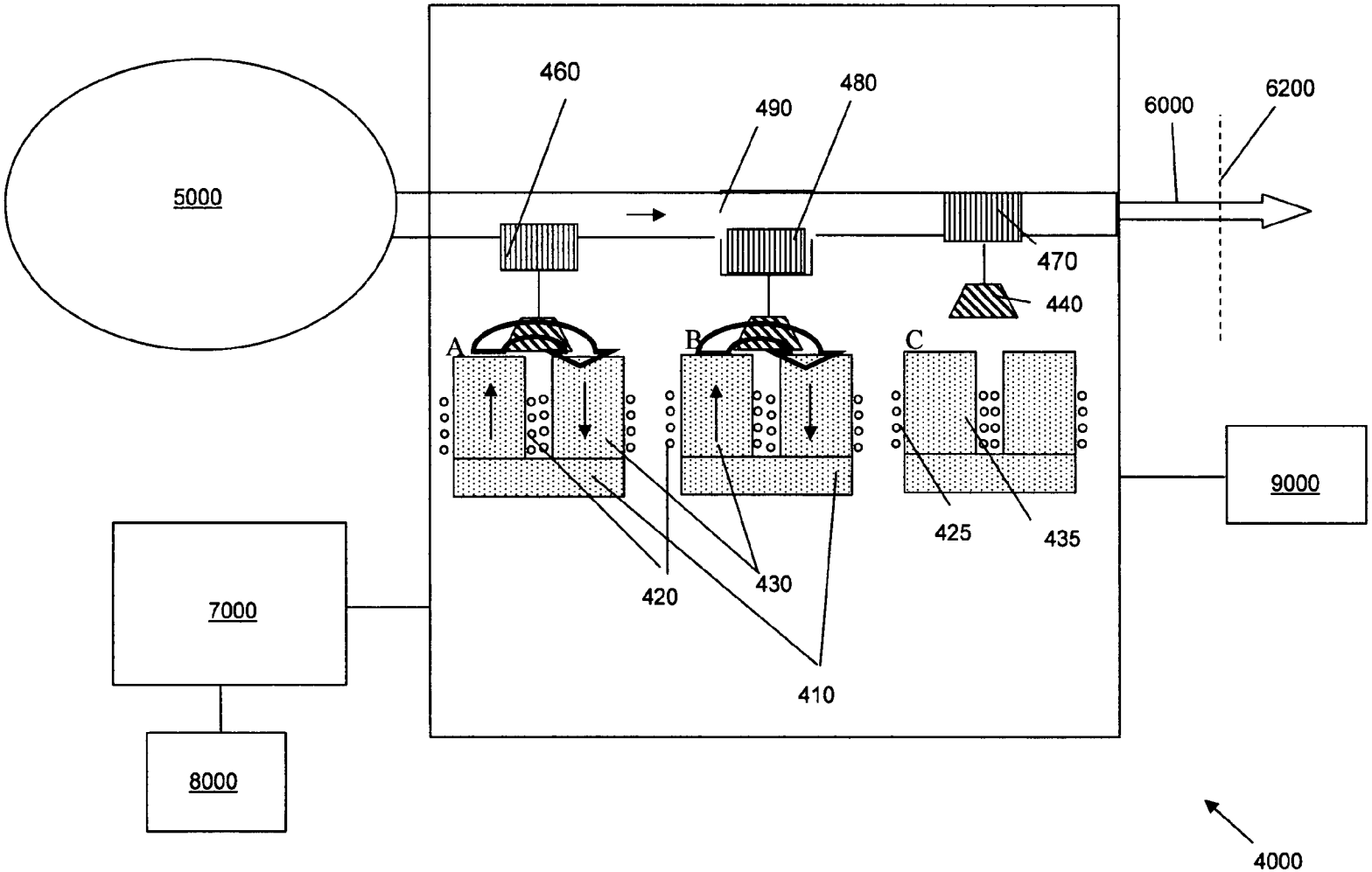
FIG. 18 is a simplified schematic view of the in-plane MEMS electromagnetic pump of FIG. 9 configured as a drug delivery system, by coupling the in-plane MEMS electromagnetic pump with a drug reservoir and cannula.

The dimensions of the coils may be, for example, 2 μm on a side, and may be made of copper, for example. There may be about 30 windings carrying 50 mA of current in the coil. Modeling predictions indicate that these 1500 mAmpere-turns will result in a field that can produce at least 3 mN of force on the permeable member, and the restoring spring may also exert this much restoring force when the current to the coils is discontinued. These forces are expected to be sufficient to pump a fluid through a sub-dermal cannula with an aperture of 200 μm at a rate of at least 60 μl/min. Thus, the in-plane electromagnetic MEMS pump is a candidate for the delivery of small, continuous doses of insulin to diabetic patients in a transdermal patch. Such a system could mimic the action of the human pancreas, and thus greatly reduce or eliminate the life threatening or life-limiting effects of diabetes. An exemplary embodiment of such a system is shown in FIG. 18 and described below with respect to that figure.

Figure 13:
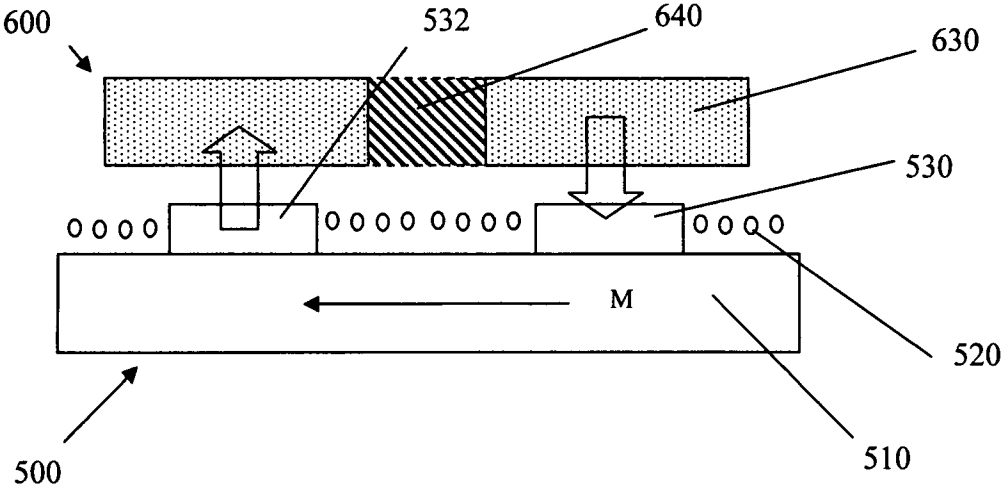
FIG. 13 is a simplified schematic cross-sectional view of an exemplary flux-generating mechanism for in-plane MEMS electromagnetic pump on a separate substrate, disposed adjacent to the electromagnetic actuator portion of the in-plane electromagnetic MEMS pump.

When an actuator substrate 600 supporting an electromagnetic actuator such as that shown in FIG. 3*a*, 3*b*, 6*a*, 6*b*, 10 or 11 is brought into proximity to the motor substrate 500, the shape and direction of the flux lines produced by the motor portion may change. This effect is illustrated in FIG. 13. Instead of simply leaping across the gap, the presence of the permeable features in the actuator substrate 500 cause the flux to enter the permeable portions of the actuator substrate instead, as this may be the lower reluctance path. Thus, the permeable cores in the actuator portion route the flux generated by the flux-generating apparatus to the gap between the permeable cores 130, 230, 330, and 430 and the permeable member 140, 240, 340, and 440. In this regard, all motor portions and actuator portions may function in basically the same way, despite their different designs.

Figure 14:
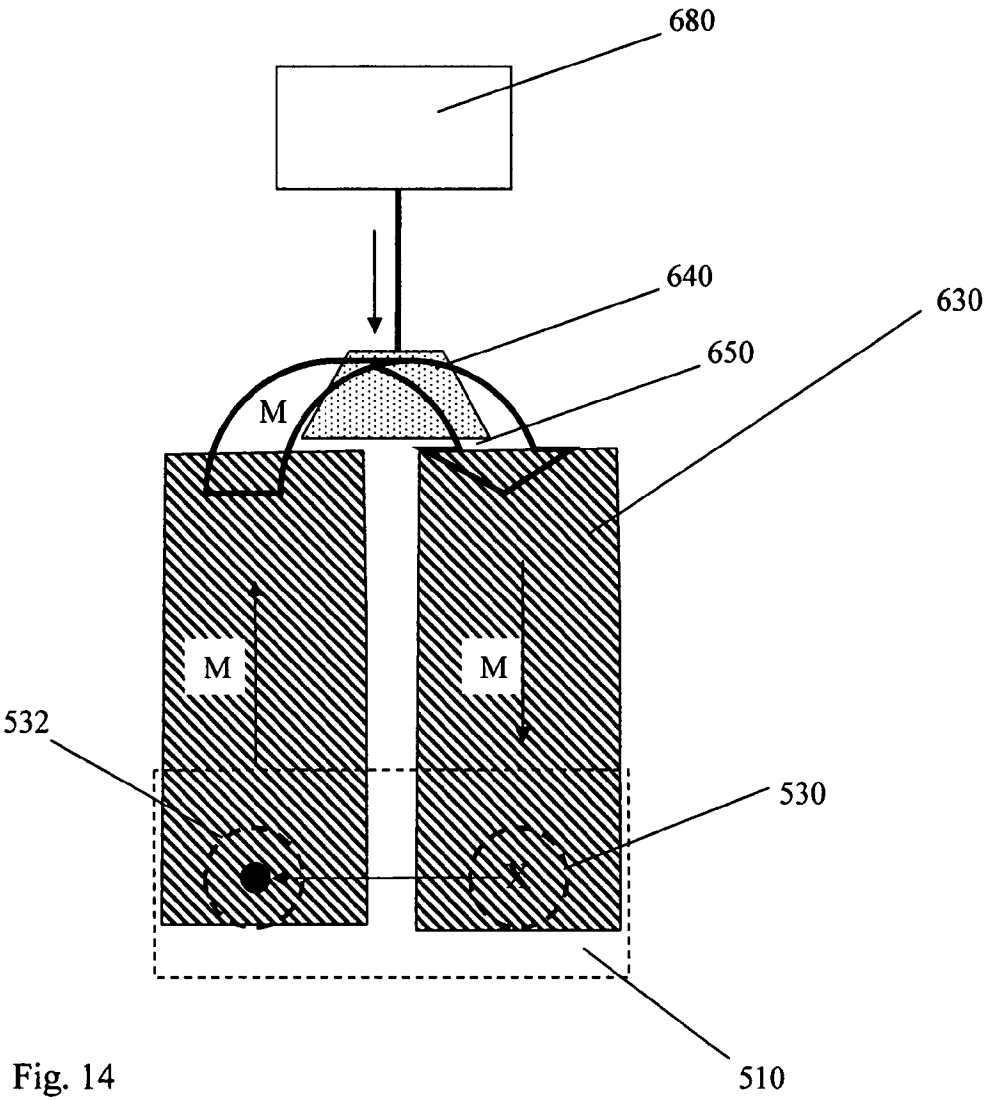
FIG. 14 is a simplified schematic plan view of the exemplary in-plane MEMS electromagnetic pump of FIG. 13 with the flux-generating apparatus disposed adjacent to the electromagnetic actuator portion of the pump.

FIG. 14 shows the magnetic circuit more clearly in plan view. The magnetic flux is generated by the coils formed over the permeable backstop 510 traverses the backstop 510 from one permeable post 530 to the other permeable post 532. From the permeable post 532, the flux enters the permeable core 630, and traverses the gap to the permeable member 640.

This draws the permeable member into the gap 650. From the permeable member 640, the flux crosses the gap 650 again, into the other permeable core, back to the other permeable post 530, thus completing the magnetic circuit. For simplicity of depiction, the current-carrying coils are not shown in FIG. 14.

Figure 15:
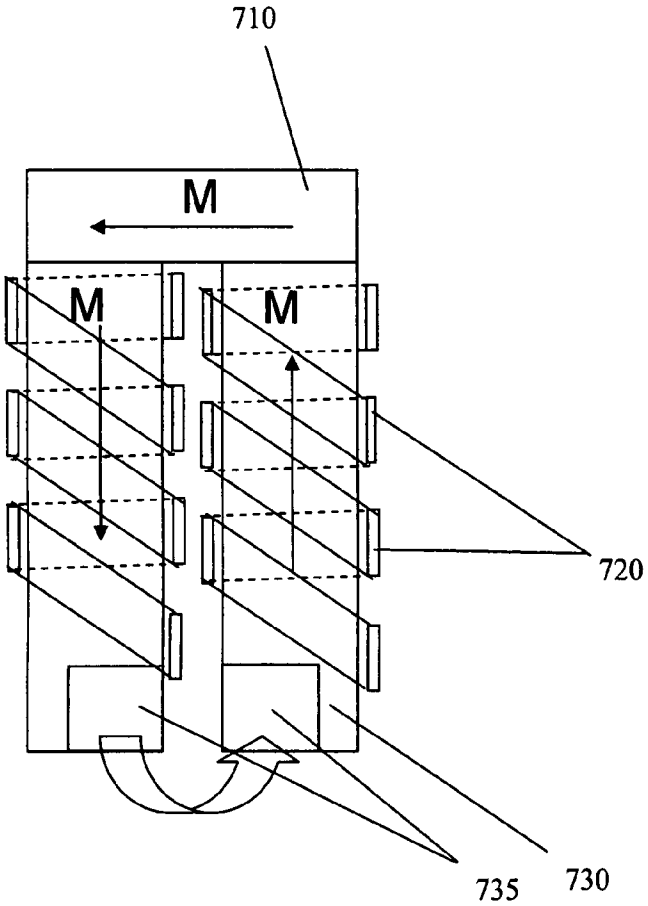
FIG. 15 is a simplified schematic cross-sectional view of an alternative design for the flux-generating apparatus for in-plane MEMS electromagnetic pump on a separate substrate.

FIG. 15 shows an alternative design for the flux-generating apparatus. In this design, the axis of the coils is parallel to the substrate surface, rather than perpendicular to it, forming a toroidal configuration with the axis of the toroid parallel to the substrate surface. In this approach, a set of conductors is deposited, then the permeable material for the cores 730 is deposited over the conductors, followed by another set of conductors deposited over the permeable material. This design may have the advantage of more efficient use of current to generate the magnetic field, as the windings may be made tighter. However, this approach may also have greater processing difficulty, as the conductors underneath the permeable cores must be mated with the conductors lying overtop the permeable cores, in order to form the coils 720 and conduct the current.

Nonetheless, this design functions in basically the same way as the previous designs, wherein current circulating in the coils generates a magnetic field in the permeable cores. Flux is generated by the current flowing in the coils 720 in the permeable cores 730. This flux travels across the backstop 710 to the other permeable core. The flux then travels to a post 735 disposed perpendicularly to the permeable cores 730, which directs the flux out of the plane of the motor substrate. In the absence of the actuator substrate, this flux simply leaps across the gap to the other post 735, back to the permeable core 730 to complete the circuit. This situation is illustrated in FIG. 15.

Figure 16:
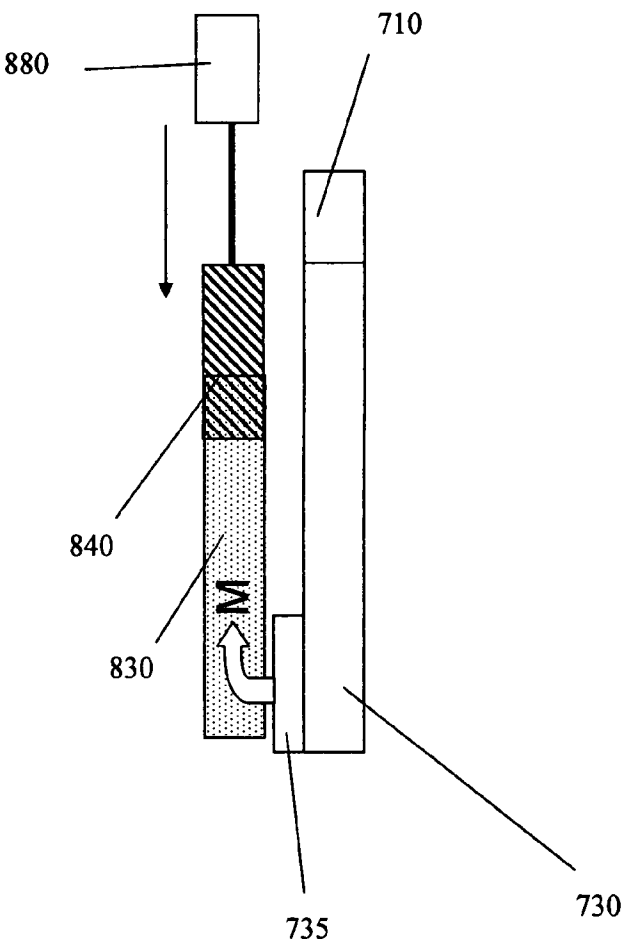
FIG. 16 is a simplified schematic cross-sectional view of the alternative design for flux-generating apparatus for in-plane MEMS electromagnetic pump on a separate substrate, disposed adjacent to the electromagnetic actuator portion of the in-plane electromagnetic MEMS pump.

When the actuator substrate is brought adjacent to and in proximity with the motor substrate, the flux path changes to take advantage of the presence of permeable material in the actuator substrate. As shown in FIG. 16, instead of merely leaping across the gap between the posts 735, the flux enters the permeable cores 830 of the actuator substrate. From the cores 830, it travels to the permeable member 840, drawing the member in, and to the other core back to the motor substrate 700 to complete the magnetic circuit.

Figure 17:
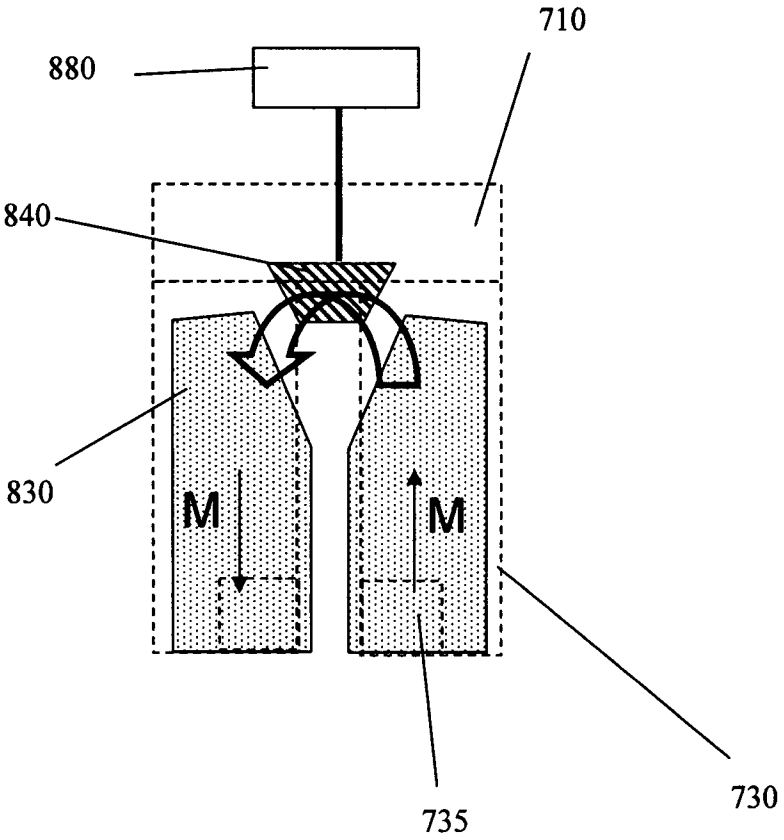
FIG. 17 is a simplified schematic plan view of the alternative in-plane MEMS electromagnetic pump of FIG. 16 with the flux-generating apparatus disposed adjacent to the electromagnetic actuator portion of the pump.

FIG. 17 shows the magnetic circuit more clearly in plan view. The magnetic flux is generated by the coils 720 formed around the permeable cores 730 and traverses the backstop 710 from one permeable core to the other permeable core 730. From the permeable core 730 the flux is delivered to the permeable post 735. From the permeable post 735, the flux enters the permeable core 830 on the actuator substrate 800, and traverses the gap 850 to the permeable member 840. This draws the permeable member 840 into the gap 850. From the permeable member 840, the flux crosses the gap 850 again, into the other permeable core 830, back to the other permeable post 735, thus completing the magnetic circuit. For simplicity of depiction, the current-carrying coils are not shown in FIG. 17.

There are a number of applications for the in-plane electromagnetic MEMS pump. One exemplary application is as a low-dosage delivery mechanism 4000 for a therapeutic substance into the body of a patient in need of that substance. In this application, the in-plane MEMS electromagnetic pump may be coupled to a drug reservoir 5000 and a cannula 6000 as shown in FIG. 18. However, it should be understood that the in-plane MEMS electromagnetic pump is only one option for such a system, and that other microfabricated pumping mechanisms could be employed, such as a microfabricated piezoelectric pump. Other such mechanisms may be microfabricated on a substrate, such that the mechanism has a feature with a characteristic dimension on the order of 1000 μm or less.

The drug reservoir 5000 may hold a volume of the therapeutic substance, which is pumped into the patient according to his needs, or according to a predetermined schedule, or according to a profile stored in the memory of a microprocessor 7000. The cannula 6000 may be a transdermal needle, which delivers the therapeutic substance to a layer of tissue under the skin 6200, such as muscle or fat. The location of the cannula 6000 and its depth may depend on the therapy being applied. For example, in the case of diabetic patients, the drug reservoir 5000 may be filled with insulin, and the cannula 6000 may deliver the insulin from the drug reservoir 5000 to a subcutaneous region in the patient. The insulin may be forced to flow from the reservoir 5000 through the cannula 6000 by the microfabricated pump 4000. In one exemplary embodiment, the microfabricated pump 4000 uses an in-plane MEMS electromagnetic pump 400. The operation of the pump 400 may be under the control of the microprocessor 7000, according to a preset schedule, or according to input from the patient, or in response to another device 8000 which may be a biochemical sensor which is responsive to a condition of a patient, and generates a signal indicative of that condition. In one embodiment, the sensor may detect the presence of, the absence of or the level of some compound, and activate the microfabricated pump 400 accordingly, in response to this measurement. The microfabricated pump 400 may be powered by a power source 9000, such as a battery, which may be located onboard the drug delivery system and implanted in the patient, or worn externally, as described below.

When the drug delivery system illustrated in FIG. 18 is configured to deliver insulin to a diabetic patient, for example, the drug reservoir may contain about 300 units of insulin, enough to provide about 10 days worth of the drug to a diabetic patient. The pumping volume of the in-plane electromagnetic MEMS pump described above may be about 0.5 nl. Theoretical models predict that the magnetic field generates enough force to draw the piston down within about 200 μsec, and the restoring springs return it to its position in about the same time, depending on the viscosity of the fluid and other design choices. Thus, a pumping speed of up to 150 μl/min could theoretically be achieved using the designs described above. However, to allow for some leakage, viscosity effects and other losses, a pumping rate of about 60 μl/min may be readily achievable. At this pumping rate, a 10 unit dose of insulin would take about 1.6 minutes to administer. Of course, instead of a single administration, this dosage could be administered slowly or over several hours by activating the pump only for short intervals, or at a lower cycle rate. Assuming three such dosages per day, a patient may operate the pump on an SR41-type button battery for about 10.5 days before replacing the battery, consistent with the capacity of the drug reservoir. Conveniently, the presently marketed insulin pumps and pens have insulin-containing storage cartridges that need to be replaced every 3-30 days, so that replacement of components or containers on this time interval is familiar to most diabetic patients.

Each of the designs shown in FIGS. **2*a*-17** have at least one common characteristic: they have a wet region which was normally filled with fluid, and was necessarily in communication with a dry region that contained the actuation means, and was preferably kept dry. The two regions were defined by narrow passages between them and/or the application of a hydrophobic or hydrophilic material. For this reason, the head pressure that the pump is capable of generating is limited to the ability of the dry region to resist the intrusion of the pumped fluid. This may limit the performance of such pump designs, in terms of head pressure or flow delivered.

Figure 19:
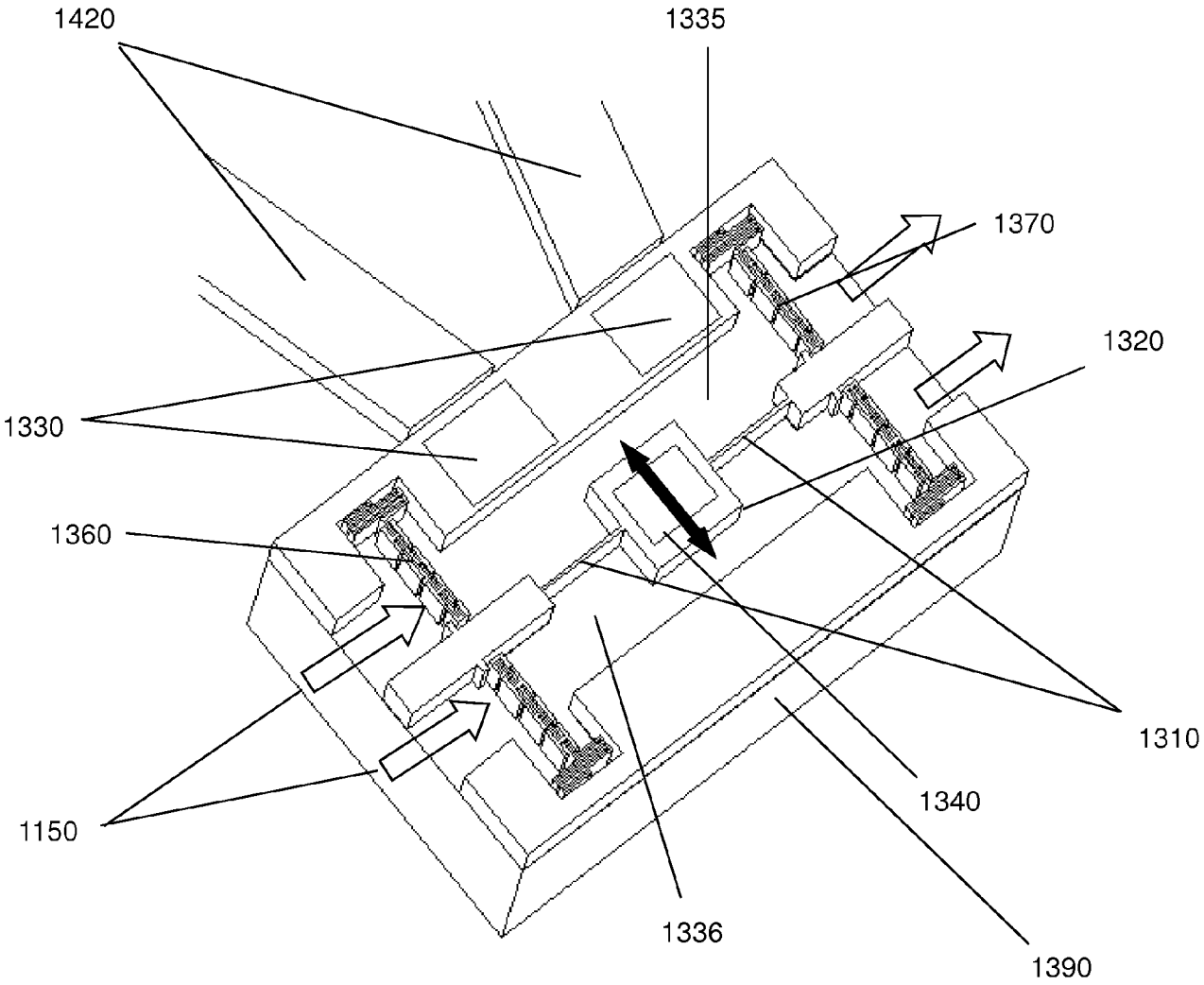
FIG. 19 is a simplified schematic perspective view of an in-plane MEMS electromagnetic pump which does not need a liquid barrier between wet and dry regions.

FIG. 19 is a simplified schematic perspective view of an in-plane MEMS electromagnetic pump which does not have such a limitation, because the wet region is totally contained and not in fluid communication with the actuation means. This in-plane MEMS electromagnetic pump may have a movable piston on a flexible diaphragm that separates two fluid chambers, wherein the piston is caused to move by a force-generating device located outside the fluid chambers. The actuation mechanism may be an action-at-a-distance mechanism, for example, electrostatic or electromagnetic forces.

One exemplary embodiment of the device 1300 may use a movable pumping element, member 1320 upon which a magnetically permeable material 1340 is formed or inlaid. The movable member 1320 may be connected to the walls of a fluid cavity by a flexible membrane or diaphragm 1310. This flexible membrane or diaphragm 1310 is the restoring spring, corresponding to reference number 450 in *Fig*. 10. The diaphragm 1310 may separate two fluid chambers, an upper chamber 1335 from a lower chamber 1336. It should be understood that the terms "upper" and "lower" are arbitrary distinctions, and do not depend on the orientation of the device 1300, but may instead be referred to as a "first" chamber and a "second" chamber. For clarity with reference to FIG. 19, the terms "upper" and "lower" will be used.

A set of valves 1360 and 1370 allow the fluid to pass through the upper chamber 1335 in one direction only when the pump is activated. Another set of similar valves may be disposed in the lower chamber 1336. These valves may be active valves, or more preferably, the valves may be passive valves as shown in FIG. 19. The passive valves open and close in response to the fluid pressure caused by the pump. When positive pressure is exerted on the fluid in the upper chamber 1335, output valve 1370 may open expelling fluid from the upper chamber 1335 When negative pressure (suction) is exerted on the fluid in the upper chamber, input valve 1360 may open, drawing fluid into the upper chamber 1335.

The in-plane MEMS electromagnetic pump 1300 may also have a set of stationary magnetic poles 1330, which interact with the magnetic flux produced by an adjacent motor, which will be more fully described below with respect to FIG. 20.

The diaphragm 1310 may be made sufficiently flexible so that the movable member 1320 is able to move back and forth as shown in FIG. 19, upon activation of the actuation mechanism. Upon movement upwards, the piston 1320 and flexible diaphragm 1310 will exert pressure on the fluid in the upper chamber 1335. The pressure will cause output valve 1370 to open, expelling fluid from the upper chamber 1335. This same movement may cause the fluid to be drawn into the lower chamber 1336. Upon downward movement of the piston 1320 and flexible diaphragm 1310, negative pressure on the fluid will cause the input valve 1360 to open, drawing fluid into the upper chamber 1335 and expelling fluid from the lower chamber 1336. In one exemplary embodiment, the diaphragm 1310 is made from the device layer of a silicon-on-insulator substrate, by etching the outline of the diaphragm and then removing the remaining dielectric which attaches the diaphragm to the handle layer of the silicon-on-insulator substrate. Additional details of an exemplary fabrication method are given further below.

Figure 20:
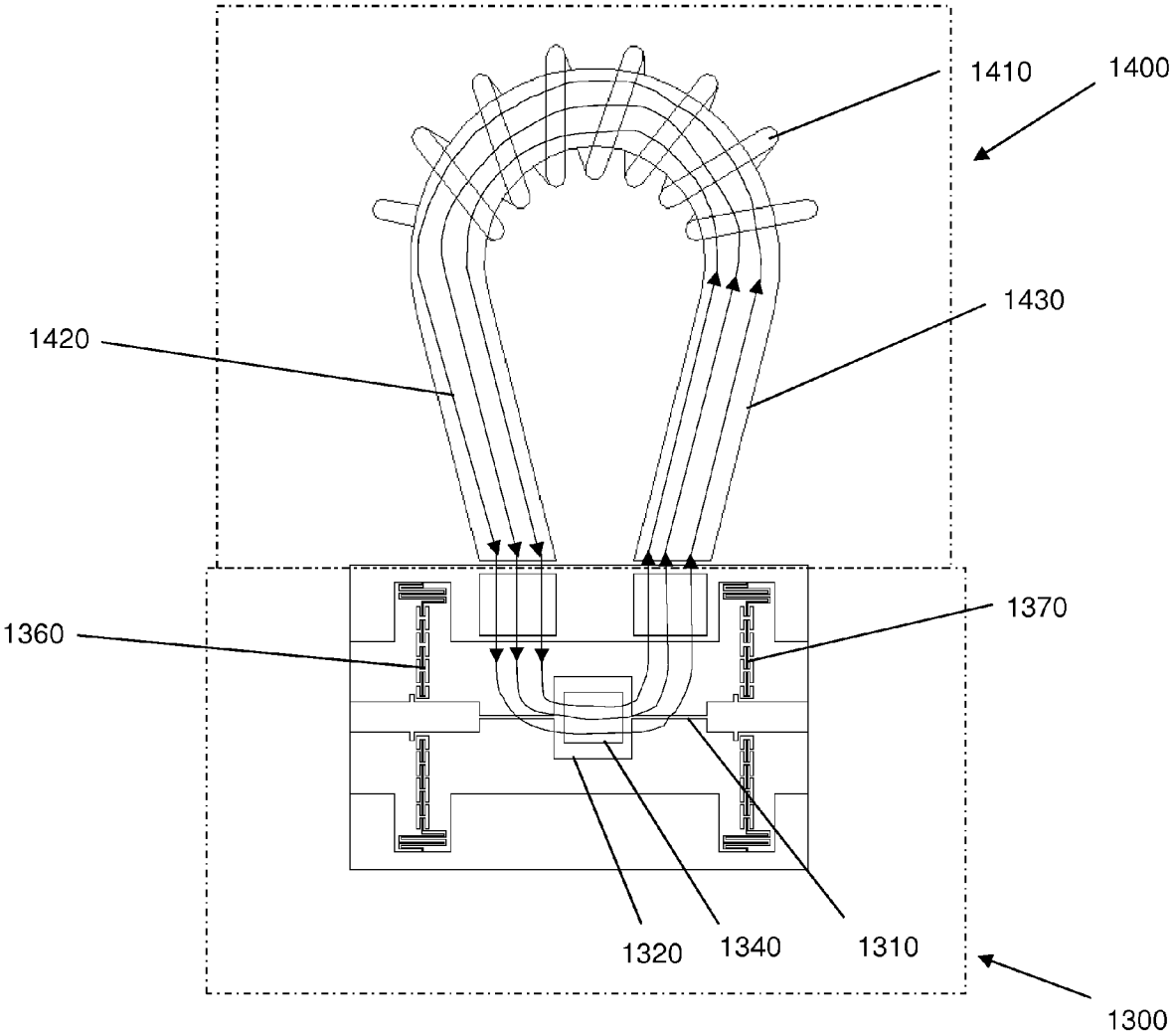
FIG. 20 is a simplified schematic plan view of the electromagnetic MEMS pump of FIG. 19 with its driving motor and coils.

FIG. 20 is a plan view of the in-plane MEMS electromagnetic pump 1300 of FIG. 19, along with its actuation means 1200. As shown in FIG. 20, the actuation means may be a magnetically permeable material 1430, such as a NiFe permalloy core, around which a number of turns of a conductor is wound to form a coil 1410. As according to standard electromagnetic theory, energizing this coil 1410 with a current causes a magnetic field 1430 to be generated along the axis of the coil. As the material 1430 is permeable, this flux causes an additional magnetization 1420 within the permeable material 1430. The coil 1410 and permeable material 1430 may be formed on a separate or separable surface 1400, as shown in FIG. 20. This may decrease the cost of the pump chip. The coil 1410 and permeable material 1430 will generate the flux that actuates the pumping element 1320.

When the coil 1410 is energize, flux travels along the permeable core 1430 to the edge of the surface. At this point, the flux must leap across the surface 1425 into the area beyond, in order to reenter the other surface 1426 of the core to complete the magnetic circuit. If the substrate supporting the in-plane MEMS electromagnetic pump 1300 is brought into proximity with the motor substrate 1400, the flux instead will cross the gap between the substrates and enter the stationary poles 1330 of the in-plane MEMS electromagnetic pump 1300. The flux will then leap between the stationary poles 1330, which will tend to draw the permeable material 1340 on the movable pumping element 1320 toward the stationary poles 1330. Thus, activating the coil 1410 will cause the upstroke of the movable piston, and force fluid to be expelled from the upper chamber 1335. This same action will cause fluid to enter the lower chamber 1336 through its input valve.

When the current to the coil is discontinued, the movable piston 1320 will relax to its quiescent position. This will force the fluid to be expelled from the lower chamber and cause fluid to be drawn again into the upper chamber. It should be noted that although FIGS. 19 and 20 have the fluid flows from the upper chamber 1335 and lower chamber 1336 in the same direction, they may also be configured to pump in anti-parallel directions, by changing the angles of the passive valves. This may be convenient for applications needing anti-parallel flows, for example, in a situation needing more than one therapeutic agent to be delivered to a patient simultaneously.

Figure 21:
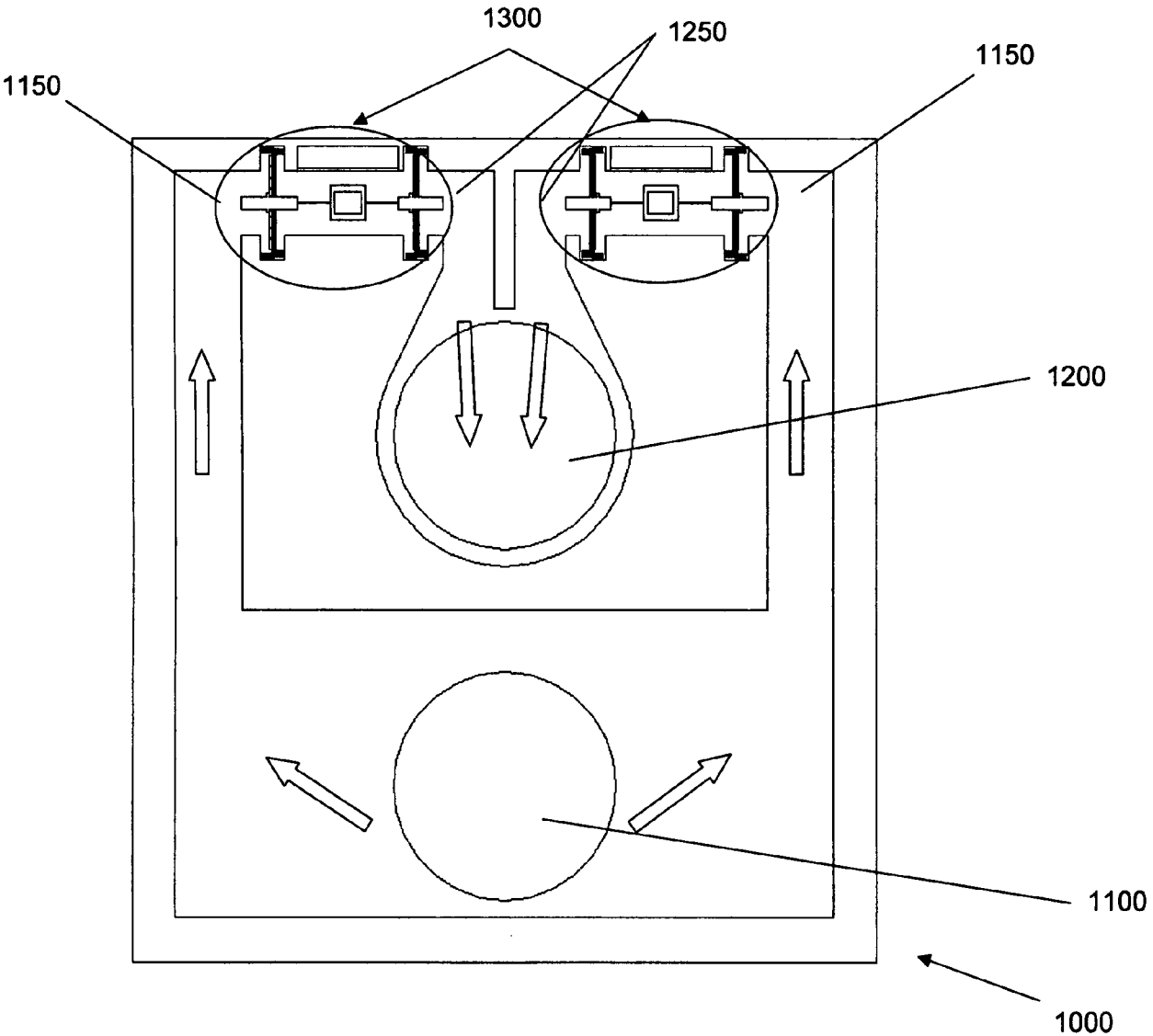
FIG. 21 is a simplified schematic view of two electromagnetic MEMS pumps of FIG. 19 coupled to input and output orifices to form a drug delivery system.

FIG. 21 illustrates one possible application of the in-plane MEMS electromagnetic pump of FIGS. 19 and 20 in a drug delivery system 1500. The drug delivery system 1500 may include an input orifice 1600 and an output orifice 1700 which are connected by microfluidic channels 1550. In each microfluidic channel 1550 is disposed an in-plane MEMS electromagnetic pump 1300, such as that depicted in FIG. 19. For simplicity, the adjacent motors 1400 used to drive the pumps 1300 are not shown in FIG. 21. However, it should be understood that in-plane MEMS electromagnetic pumps 1300 may be driven by one or more associated electromagnetic motors, such as that depicted in FIG. 20. The two pumps 1300 may be configured to operate together, in phase, such that both corresponding chambers output fluid to the output orifice 1700 simultaneously. Alternatively, the two pumps may be configured to operate out of phase, or asynchronously.

The description will now turn to fabrication of the actuator devices shown in FIGS. 10, 11, and 19 and alternative designs for the flux-generating mechanisms shown schematically in FIGS. 12-18 and 20. Although the designs shown in FIGS. 10, 11 and 19 may appear complicated, their fabrication is straightforward because all the complexity occurs in the same plane, and thus the structures may be formed with a single mask or mask set. The magnetically permeable features of the cores 130, 230, 330, 430 and 1330 first may be created by depositing a permeable material such as nickel-iron permalloy into a cavity of the appropriate shape previously created in the device layer of a silicon-on-insulator (SOI) substrate 1390. For example, the permalloy may be deposited using well-known electroplating techniques. The resulting permeable feature may then be planarized using, for example, chemical-mechanical planarization (CMP). The complex shape of the shaft, pumping element and restoring springs may then be easily created in a single step by, for example, deep reactive ion etching of the shape in the device layer. These movable features may be released from the substrate by etching the underlying oxide layer of the SOI (actuator) substrate 1390. Techniques for accomplishing these steps are described more fully in U.S. Pat. Nos. 6,838,056, 7,220,594, and 7,229,838, each of which is incorporated by reference herein in its entirety. The fluid path may be sealed by bonding a top wafer to the actuator wafer to form the MEMS pump wafer. This top wafer may be any convenient material, such as silicon, glass, quartz or ceramic. The bonding material may be any adhesive substance that can maintain a fluid seal, such as a metal, epoxy or frit adhesive. Through wafer apertures may be formed in this lid wafer either before or after bonding, to provide fluid access to the input or output channels.

The flux-generating mechanism may be fabricated on a motor substrate by first depositing the permeable cores 510 and 530 on the surface of the substrate. A seed layer may then be deposited over the permeable cores and covered with photoresist. The photoresist may then be patterned to create a stencil for the plating of the copper coils. The coils are then plated in the stencil and the stencil subsequently removed. Details as to the deposition of the permeable material, deposition of the seed layer, deposition and patterning of the photoresist and plating of the copper coils, is well known in the art or described in further detail in the '056, '594 or '838 patents and thus will not be described further herein. It should be understood that electroplating of the copper coils is only one exemplary method, and that other methods may be used to form the coils, such as ion beam deposition, ion milling and lift-off methods, as well as hand-winding a coil onto a permeable core.

The motor substrate may then be coupled to the actuator substrate 1390 by any convenient mechanism, such as glues, cements or epoxies. This bond need not be hermetic or even watertight, as it does not seal fluid. It is recommended, however, that the bond maintain a close proximity between the permeable cores of the motor substrate and the permeable cores of the actuator substrate, in order to obtain efficient coupling of the magnetic flux into the actuator substrate. Typically, maintaining a separation of less than about 2 microns is sufficient. In some embodiments, the motor substrate may not be coupled directly to the actuator substrate, but instead may be held in close proximity to the actuator substrate, but the surfaces of the two devices, actuator and motor, remain separate or at least separable.

The fluid input and output lines may be capillary tubing made of polyimide-jacketed quartz or a polymer material such as polyetheretherketone (PEEK) which may be several hundred microns in diameter. These fine tubes may, in turn, be glued to the orifices of the MEMS pump wafer using, for example, a two-part 5-minute epoxy, or any of a number of other suitable adhesives. Using tubing bores and channels of 20 □m to 100 □m, it is clear that this apparatus is capable of delivering slurry-based therapeutic substances which have particulates suspended in a conveying fluid, as well as pure fluid-based substances.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. While the embodiment described above uses a particular design of the in-plane MEMS electromagnetic pump in a drug delivery system, it should be understood that the specific pump design is exemplary only, and that other designs may be used in the system. Furthermore, although embodiments are described each with a certain combination of features, it should be understood that any of a number of other embodiments are envisioned, which may have different combinations of features. Finally, details related to the specific design features of the in-plane electromagnetic MEMS pumps, such as coil number and dimensions, are intended to be illustrative only, and the invention is not limited to such embodiments. Accordingly, the exemplary implementations set forth above, are intended to be illustrative, not limiting.

What is claimed is:

1. A microfabricated fluid pump, comprising:

a substrate having a top surface;

at least one fluid valve formed on the top surface of the substrate which is configured to move in a plane substantially parallel to the top surface of the substrate; and a pumping element with a magnetically permeable portion, wherein the pumping element moves in the plane substantially parallel to the top surface and exerts a pumping force on a fluid which moves the fluid, and wherein the pumping element and the at least one fluid valve moves the fluid in a direction substantially in the plane.

2. The microfabricated fluid pump of claim 1, further comprising:

a magnetic force-generating mechanism which generates a force to move the magnetically permeable portion of the pumping element, and the magnetic force-generating mechanism is not coupled to the substrate.

3. The microfabricated fluid pump of claim 1, further comprising:

a magnetically permeable member coupled to a shaft formed in the substrate surface, wherein the shaft and the magnetically permeable member are configured to move in a direction substantially parallel to the substrate surface, and wherein the pumping element is also coupled to the shaft.

4. The microfabricated fluid pump of claim 1, wherein the at least one valve is a passive valve, actuated by pressure of the fluid against the valve, and having a hinge allowing movement in the plane substantially paralled to the top surface of the substrate.

5. The microfabricated fluid pump of claim 4, wherein the passive valve comprises a plate coupled to a wall in the substrate by the hinge, which allows the valve to open in one direction, wherein the pump has a détente feature configured to prevent the plate from moving in an opposite direction.

6. The microfabricated pump of claim 2, wherein the pumping element is a movable member coupled to a flexible diaphragm, wherein the diaphragm separates two fluidic chambers.

7. The microfabricated pump of claim 6, wherein the movable member comprises a permeable material, the permeable material interacting electromagnetically with the magnetic force-generating mechanism, which causes movement of the movable member electromagnetically.

8. The microfabricated fluid pump of claim 6, wherein movement of the movable member causes one fluidic chamber to expel fluid out through one fluidic valve, and the other fluidic chamber to draw fluid in through another fluidic valve.

9. The microfabricated fluid pump of claim 3, wherein the permeable member has at least one of a keystone shape and a clapper shape.

10. The microfabricated fluid pump of claim 2, wherein the magnetic force-generating mechanism is an electromagnetic device, separable from the substrate, and wherein flux generated by the electromagnetic device is transferred to the substrate across a narrow gap.

11. The microfabricated fluid pump of claim 10, wherein the force-generating mechanism is a planar, pancake coil wrapped around a magnetically permeable core.

12. The microfabricated fluid pump of claim 10, wherein the force-generating mechanism is a toroidal coil wrapped around a magnetically permeable core.

13. The microfabricated fluid pump of claim 1, further comprising at least one restoring spring coupled to the pumping element, wherein the restoring spring is configured to resist movement of the pumping element in at least one of a plane perpendicular to and a plane parallel to the substrate surface.

14. A system for delivering a therapeutic substance to a patient, comprising:

a reservoir containing a volume of the therapeutic substance;

a cannula that delivers the therapeutic substance to a region beneath an outer layer of skin of the patient; and the microfabricated fluid pump of claim 1, wherein a characteristic dimension of the microfabricated fluid pump is less than 1000 um, and wherein the microfabricated fluid pump is configured to pump the therapeutic substance from the reservoir through the cannula to the patient.

15. The system of claim 14, further comprising:

a microprocessor which controls the microfabricated fluid pump, and operates the pump according to at least one of: an algorithm stored in a memory, the commands of a user, and a signal from a biochemical sensor.

16. The system of claim 15, further comprising:

a sensor coupled to the microprocessor, wherein the sensor is responsive to a condition of the patient, and generates a signal indicative of that condition.

17. The system of claim 14, further comprising:

a power source which powers the microfabricated fluid pump.

18. The system of claim 14, wherein the microfabricated fluid pump is actuated by an electromagnetic interaction, and a pumping element of the microfabricated fluid pump moves the therapeutic substance in a plane substantially parallel to the surface of the fabrication substrate in response to the electromagnetic interaction.

19. The system of claim 14, wherein the microfabricated fluid pump comprises a permeable member coupled to a pumping element, wherein the permeable member and pumping element move substantially in a plane parallel to the surface of the substrate.

20. The system of claim 14, wherein the therapeutic substance comprises a slurry of particles suspended in a fluid.

21. The system of claim 20, wherein the particles have a characteristic dimension of at least about 10 μm.

22. A method for delivering a therapeutic substance to a patient, comprising:

attaching the system of claim 14 to the patient;

inserting the cannula into the skin of the patient; and activating the microfabricated fluid pump.

23. A method for making a system, comprising:

forming the microfabricated fluid pump of claim 1, wherein the microfabricated fluid pump has a characteristic dimension less than about 1000 um;

coupling the microfabricated fluid pump to a a reservoir containing a volume of the therapeutic substance;

coupling the microfabricated fluid pump to a cannula that delivers the therapeutic substance to a region beneath an outer layer of skin of a patient, wherein the microfabricated fluid pump is configured to pump the therapeutic substance from the reservoir through the cannula to the patient.

24. The method of claim 23, wherein forming the microfabricated fluid pump comprises:

forming a magnetic actuator portion, wherein the magnetic actuator portion includes a permeable member configured to move in a plane parallel to the surface of the substrate by interaction with magnetic flux;

forming a flux generating portion which generates magnetic flux which is coupled into the permeable member to cause motion of the permeable member.

25. The method of claim 24, wherein forming the magnetic actuator portion further comprises:

forming a permeable member coupled to a pumping element, wherein the permeable member and pumping element are configured to move substantially in the plane parallel to the substrate.

26. The method of claim 25, wherein forming the magnetically permeable member is coupled to the pumping element further comprises:

depositing magnetically permeable material into a cavity formed in a device layer of a silicon-on-insulator substrate by electroplating the magnetically permeable material;

planarizing the magnetically permeable material by chemical mechanical planarization; and forming the pumping element by deep reactive ion etching an outline of the pumping element in the device layer.

27. The method of claim 24, further comprising:

coupling the flux generating portion to the magnetic actuator portion.

* * * * *